US008882932B2

(12) United States Patent
Strothoff et al.

(10) Patent No.: US 8,882,932 B2
(45) Date of Patent: Nov. 11, 2014

(54) METHODS AND COMPOSITIONS FOR THE REMOVAL OF STARCH

(75) Inventors: Werner Strothoff, Fuchtorf (DE); Winfried Troll, Dusseldorf (DE); Helmut Maier, Dusseldorf (DE); John P. Furber, St. Paul, MN (US); Bryan A. Maser, Hugo, MN (US); Michael E. Besse, Golden Valley, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/527,487

(22) Filed: Jun. 19, 2012

(65) Prior Publication Data

US 2012/0291820 A1 Nov. 22, 2012

Related U.S. Application Data

(63) Continuation of application No. 13/096,151, filed on May 20, 2011, now Pat. No. 8,709,167, which is a continuation of application No. 10/740,371, filed on Dec. 18, 2003, now Pat. No. 8,092,613.

(51) Int. Cl.

| | |
|---|---|
| ***B08B 3/00*** | (2006.01) |
| ***A47L 15/00*** | (2006.01) |
| ***C11D 11/00*** | (2006.01) |
| ***B08B 3/02*** | (2006.01) |
| ***C11D 3/04*** | (2006.01) |
| ***B08B 3/04*** | (2006.01) |
| ***C11D 3/20*** | (2006.01) |

(52) U.S. Cl.

CPC ..... *A47L 15/0002* (2013.01); *A47L 15/0076* (2013.01); *C11D 11/0064* (2013.01); *C11D 11/0023* (2013.01); *B08B 3/02* (2013.01); *C11D 3/044* (2013.01); *B08B 3/04* (2013.01); *C11D 3/2075* (2013.01); *A47L 15/0007* (2013.01); *A47L 15/0005* (2013.01); *C11D 3/042* (2013.01)

USPC ..... 134/56 D; 134/57 D; 134/58 D; 134/25.2

(58) Field of Classification Search

USPC ..... 134/56 D, 57 D, 58 D, 25.2

See application file for complete search history.

(56) References Cited

U.S. PATENT DOCUMENTS

| | | | | |
|---|---|---|---|---|
| 2,825,666 | A * | 3/1958 | Stoddard | 134/25.2 |
| 3,896,827 | A | 7/1975 | Robinson | |

(Continued)

FOREIGN PATENT DOCUMENTS

| | | |
|---|---|---|
| DE | 1628632 | 8/1970 |
| DE | 1703441 | 12/1971 |

(Continued)

OTHER PUBLICATIONS

Rompp Chemie Lexikon 9th Edition (1989), pp. 350-351.

(Continued)

*Primary Examiner* — Alexander Markoff

(74) *Attorney, Agent, or Firm* — Merchant & Gould PC

(57) ABSTRACT

A method of warewashing for the removal of starch is described herein. The method includes applying an alkaline composition to a dish, then applying an acidic composition to a dish, and then applying a second alkaline composition to the dish. The method may include additional steps. Compositions for using with the method are also disclosed. Finally, dish machines that may be used in accordance with the method are disclosed.

10 Claims, 5 Drawing Sheets

(56) References Cited

U.S. PATENT DOCUMENTS

| | | | | |
|---|---|---|---|---|
| 4,313,451 | A | 2/1982 | Vilen | |
| 4,501,681 | A * | 2/1985 | Groult et al. | 510/226 |
| 4,750,942 | A * | 6/1988 | van Dijk et al. | 134/25.2 |
| 5,704,380 | A | 1/1998 | Zelniker et al. | |
| 5,725,002 | A | 3/1998 | Payzant | |
| 5,879,469 | A * | 3/1999 | Avram | 134/25.2 |
| 5,972,870 | A | 10/1999 | Anderson | |
| 6,098,639 | A | 8/2000 | Robinson | |
| 6,484,734 | B1 * | 11/2002 | Everson et al. | 134/25.2 |
| 2002/0065205 | A1 * | 5/2002 | Maria Neplenbroek et al. | 510/220 |
| 2002/0187910 | A1 * | 12/2002 | Speed et al. | 510/295 |
| 2012/0291820 | A1 * | 11/2012 | Strothoff et al. | 134/99.2 |

FOREIGN PATENT DOCUMENTS

| | | |
|---|---|---|
| DE | 2343145 | 3/1975 |
| DE | 3326459 | 1/1985 |
| DE | 19503060 | 8/1996 |
| EP | 0151203 | 2/1984 |
| EP | 0217732 | 4/1987 |
| EP | 0761156 | 9/1996 |
| EP | 0806472 | 11/1997 |
| EP | 0808894 | 11/1997 |
| EP | 0282214 | 9/1999 |
| EP | 1026230 | 8/2000 |
| EP | 1567289 | 11/2003 |
| EP | 1477552 | 11/2004 |
| EP | 1239028 | 3/2005 |
| FR | 2206382 | 11/1972 |
| GB | 798274 | 7/1998 |
| JP | 62225600 | 10/1987 |
| WO | WO9107904 | 6/1991 |
| WO | WO93/05696 | 9/1992 |
| WO | WO92/18047 | 10/1992 |
| WO | WO95/14424 | 6/1995 |
| WO | WO95/24148 | 9/1995 |
| WO | WO98/30673 | 7/1998 |
| WO | WO99/00474 | 1/1999 |
| WO | WO00/43145 | 1/2000 |
| WO | WO02/31095 | 4/2002 |
| WO | WO02/100993 | 12/2002 |
| WO | WO2004/101727 | 5/2004 |
| WO | WO2004/052564 | 6/2004 |

OTHER PUBLICATIONS

Hobart LT-1 Dishwasher Product Brochure F-8314, Rev. Aug. 2003, 4 pages.

Hobart AM Select Dishwasher Product Brochure F40078, Rev. May 2011, 8 pages.

American Dish Service Parts Manual, Models L3DW and L3DWC Low-Water Dishwashers, May 2008, 28 pages.

* cited by examiner

METHODS AND COMPOSITIONS FOR THE REMOVAL OF STARCH

CROSS REFERENCE TO RELATED APPLICATIONS

This application is a continuation of U.S. application Ser. No. 13/096,151 filed Apr. 28, 2011, which is a continuation of U.S. application Ser. No. 10/740,371 filed Dec. 18, 2003, which issued as U.S. Pat. No. 8,092,613 on Jan. 10, 2012 which is related to the PCT application PCT/EP02/05964 for A Cleaning Process For The Removal Of Starch, the PCT application PCT/EP03/12366 for Acidic Cleaning II, the German application 10257391.3 for Acidic Cleaning II, the PCT application PCT/EP03/796110 for a Multi-Phase Tablet, and the PCT/EP03/12923 for a Multi-Stage Warewashing System.

FIELD OF THE INVENTION

The invention is related to a method of warewashing to remove starch. The method includes a first alkaline step, a first acidic step, and a second alkaline step. The method may include additional steps, as well as pauses and rinse steps. The method may be carried out in a variety of dish machines, including consumer and institutional dish machines.

BACKGROUND

Starchy soils are known to accumulate on dishes including for example eating utensils, plates, pots, pans, glassware, and the like. Such soils are particularly difficult to remove using conventional warewashing compositions and methods. If a starchy soil is not removed during a wash cycle, starch deposits may accumulate on a dish.

In the past, starchy soils and starch buildup have been removed by subjecting the dish to a "thorough cleaning," also referred to as processing, or by manually scrubbing the dish. A thorough cleaning involves occasionally applying to the dish a cleaning composition having a substantially higher concentration than a typical cleaning composition. Both the "thorough cleaning" and manually scrubbing a dish are costly and time consuming.

There is a need to provide compositions and methods that prevent the buildup of starch on dishes and remove existing starch buildup on dishes in an efficient and cost effective manner.

SUMMARY

Surprisingly, it has been discovered that starchy soils and starch buildup may be removed using a method comprising at least a first alkaline step, a first acidic step, and a second alkaline step. The method may include additional alkaline and acidic steps. The method may also include pauses between steps as well as rinses. The method may be carried out using a variety of alkaline and acidic compositions. Finally, the method may be carried out in a variety of dish machines, include consumer and institutional dish machines.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

Figure 1:
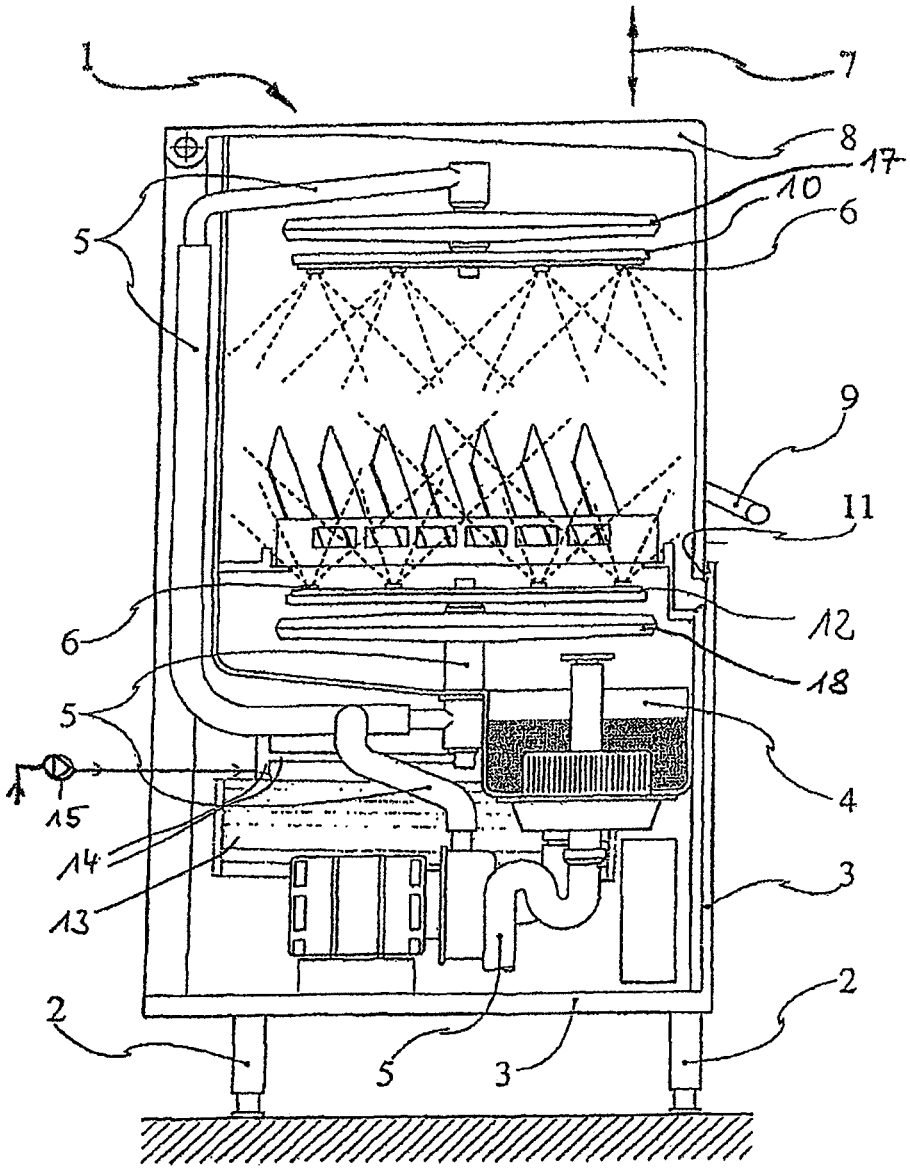
FIG. 1 shows a door dish machine where the acid is applied through the rinse arm of the dish machine.

As discussed above, the invention generally relates to a method of removing starchy soils and starch buildup from dishes. In one embodiment, the method comprises at least a first alkaline step, a first acidic step, and a second alkaline step. In another embodiment, the method may include additional alkaline or acidic steps. In yet another embodiment, the composition may include pauses between steps, as well as rinses between or after steps.

The method may use a variety of alkaline and acidic compositions. The compositions may include additional functional ingredients that improve the effectiveness of the composition or provide an additional benefit.

Finally, the method may be carried out in a variety of dish machines, including consumer and institutional dish machines.

In addition to effectively removing starch, the present method has two additional benefits. First, the presence of an acidic composition helps to remove mineral deposits from hard water or coffee and tea residues. Second, the combination of the alkaline composition plus the acidic composition creates a more neutral or neutral composition wherein the pH may range from about 7 to about 9. In some parts of the world, the wastewater must be neutralized prior to disposal. Therefore, having a final neutral composition in the present invention is desirable because there is not a need to further neutralize the composition or pay a utility fee which saves time and money.

DEFINITIONS

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The use of the terms "antimicrobial" in this application does not mean that any resulting products are approved for use as an antimicrobial agent.

Methods of Use

The invention generally relates to a method of removing starchy soils and starch buildup from dishes using at least a first alkaline step, a first acidic step, and a second alkaline step.

In one embodiment, the method may include additional alkaline and acidic steps. In this embodiment, the additional alkaline and acidic steps preferably alternate to provide an alkaline-acidic-alkaline-acidic-alkaline pattern. While it is understood that the method may include as many alkaline and acidic steps as desired, the method preferably includes at least three steps, and not more than eight steps.

In another embodiment, the method may include pauses between the alkaline and acidic steps. For example, the method may proceed according to the following: first alkaline step, first pause, first acidic step, second pause, second alkaline step, third pause, and so on. During a pause, no further cleaning agent is applied to the dish and the existing cleaning agent is allowed to stand on the dish for a period of time.

In yet another embodiment, the method may include rinses. For example, the method may proceed according to the following: first alkaline step, first acidic step, second alkaline step, rinse. Alternatively, the method may proceed according to the following: first alkaline step, first pause, first acidic step, second pause, second alkaline step, third pause, rinse.

Finally, the method may include an optional prewash step prior to the first alkaline step.

The time for each step in the method may vary depending on the dish machine, for example if the dish machine is a consumer dish machine or an institutional dish machine. The time required for a cleaning step in consumer dish machines is typically about 10 minutes to about 60 minutes. The time required for the cleaning cycle in a U.S. or Asian institutional dish machine is typically about 45 seconds to about 2 minutes, depending on the type of machine. Each method step preferably lasts from about 2 seconds to about 30 minutes.

The temperature of the cleaning solutions in each step may also vary depending on the dish machine, for example if the dish machine is a consumer dish machine or an institutional dish machine. The temperature of the cleaning solution in a consumer dish machine is typically about 110° F. (43° C.) to about 150° F. (66° C.) with a rinse up to about 160° F. (71° C.). The temperature of the cleaning solution in a high temperature institutional dish machine in the U.S. is about typically about 150° F. (66° C.) to about 165° F. (74° C.) with a rinse from about 180° F. (82° C.) to about 195° F. (91° C.). The temperature in a low temperature institutional dish machine in the U.S. is typically about 120° F. (49° C.) to about 140° F. (60° C.). Low temperature dish machines usually include at least a seven minute rinse with a sanitizing solution. The temperature in a high temperature institutional dish machine in Asia is typically from about 131° F. (55° C.) to about 136° F. (58° C.) with a final rinse at 180° F. (82° C.).

The temperature of the cleaning solutions is preferably from about 95° F. (35° C.) to about 176° F. (80° C.).

Compositions

The compositions of the invention may be either a concentrate or a diluted solution. The concentrate refers to the composition that is diluted to form the use solution. The concentrate is preferably a solid. The diluted solution refers to a diluted form of the concentrate. It may be beneficial to form the composition as a concentrate and dilute it to a diluted solution on-site. The concentrate is often easier and less expensive to ship than the use solution. It may also be beneficial to provide a concentrate that is diluted in a dish machine to form the diluted solution during the cleaning process. For example, a composition may be formed as a solid and placed in the dish machine dispenser as a solid and sprayed with water during the cleaning cycle to form a diluted solution. In a preferred embodiment, the compositions applied to the dish during cleaning are diluted solutions and not concentrates.

The compositions may be a liquid, thickened liquid, gelled liquid, paste, granular or pelletized solid material, solid block, cast solid block, powder, tablet, or the like. Liquid compositions can typically be made by forming the ingredients in an aqueous liquid or aqueous liquid solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible aqueous, aqueous liquid or mixed aqueous organic system including a gelling agent at an appropriate concentration. Solid particulate materials can be made by merely blending the dry solid ingredients in appropriate ratios or agglomerating the materials in appropriate agglomeration systems. Pelletized materials can be manufactured by compressing the solid granular or agglomerated materials in appropriate pelletizing equipment to result in appropriately sized pelletized materials. Solid block and cast solid block materials can be made by introducing into a container either a prehardened block of material or a castable liquid that hardens into a solid block within a container.

The compositions may be provided in bulk or in unit dose. For example, the compositions may be provided in a large solid block that may be used for many cleaning cycles. Alternatively, the compositions may be provided in unit dose form wherein a new composition is provided for each new cleaning cycle.

The compositions may be packaged in a variety of materials including a water soluble film, disposable plastic container, flexible bag, shrink wrap, and the like. Further, the compositions may be packaged in such a way as to allow for multiple forms of product in one package, for example, a liquid and a solid in one unit dose package.

The alkaline, acidic, and rinse compositions may be either provided or packaged separately or together. For example, the alkaline composition may be provided and packaged completely separate from the acidic composition. Alternatively, the alkaline, acidic, and rinse compositions may be provided together in one package. For example, the alkaline, acidic, and rinse compositions may be provided in a layered block or tablet wherein the first layer is the first alkaline composition, the second layer is the first acidic composition, the third layer is the second alkaline composition, and optionally, the fourth layer is the rinse composition. It is understood that this layered arrangement may be adjusted to provide for more alkaline and acidic steps as contemplated by the invention or to include additional rinses or no rinses. The individual layers preferably have different characteristics that allow them to dissolve at the appropriate time. For example, the individual layers may dissolve at different temperatures that correspond to different wash cycles; the layers may take a certain amount of time to dissolve so that they dissolve at the appropriate time during the wash cycle; or the layers may be divided by a physical barrier that allows them to dissolve at the appropriate time, such as a paraffin layer, a water soluble film, or a chemical coating.

In addition to providing the alkaline and acidic compositions in layers, the alkaline and acidic compositions may also be in separate domains. For example, the alkaline and acidic compositions may be in separate domains in a solid composition wherein each domain is dissolved by a separate spray when the particular composition is desired.

Alkaline Composition

The method of the present invention includes at least two alkaline steps wherein an alkaline composition is brought into contact with a dish during the alkaline step of the cleaning process. The alkaline composition includes one or more alkaline carriers. Some non-limiting examples of suitable alkaline carriers include the following: a hydroxide such as sodium hydroxide, or potassium hydroxide; an alkali silicate; an ethanolamine such as triethanolamine, diethanolamine, and monoethanolamine; an alkali carbonate; and mixtures thereof. The alkaline carrier is preferably a hydroxide or a mixture of hydroxides, or an alkali carbonate. The alkaline carrier is preferably present in the diluted, ready to use, alkaline composition from about 125 ppm to about 5000 ppm, more preferably from about 250 ppm to about 3000 ppm and most preferably from about 500 ppm to about 2000 ppm. The alkaline composition preferably creates a diluted solution having a pH from about 7 to about 14, more preferably from about 9 to about 13, and most preferably from about 10 to about 12. The particular alkaline carrier selected is not as important as the resulting pH. Any alkaline carrier that achieves the desired pH may be used in the alkaline composition of the invention. The first alkaline cleaning step and the second alkaline cleaning step may use the same alkaline composition or different alkaline compositions.

The alkaline composition may include additional ingredients. For example, the alkaline composition may include a water conditioning agent, an enzyme, an enzyme stabilizing system, a surfactant, a binding agent, an antimicrobial agent, a bleaching agent, a defoaming agent/foam inhibitor, an antiredeposition agent, a dye or odorant, a carrier, a hydrotrope and mixtures thereof.

Water Conditioning Agent

The water conditioning agent can be referred to as a detergent builder and/or chelating agent and generally provides cleaning properties and chelating properties. Exemplary detergent builders include sodium sulphate, sodium chloride, starch, sugars, $C_1$-$C_{10}$ alkylene glycols such as propylene glycol, and the like. Exemplary chelating agents include phosphates, phosphonates, and amino-acetates. Exemplary phosphates include sodium orthophosphate, potassium orthophosphate, sodium pyrophosphate, potassium pyrophosphate, sodium tripolyphosphate (STPP), and sodium hexametaphosphate. Exemplary phosphonates include 1-hydroxyethane-1,1-diphosphonic acid, aminotrimethylene phosphonic acid, diethylenetriaminepenta(methylenephosphonic acid), 1-hydroxyethane-1,1-diphosphonic acid $CH._3C(OH)[PO(OH)_2]_2$, aminotri(methylenephosphonic acid) $N[CH_2PO(OH)_2]_3$, aminotri(methylenephosphonate), sodium salt

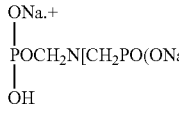

2-hydroxyethyliminobis(methylenephosphonic acid) $HOCH_2CH_2N[CH_2PO(OH)_2]_2$, diethylenetriaminepenta(methylenephosphonic acid) $(HO)_2POCH_2N[CH_2CH_2N[CH_2PO(OH)_2]_2]_2$, diethylenetriaminepenta(methylenephosphonate), sodium salt $C_9H(_{28}\text{-}x)N_3Na_xO_{15}P_5$ (x=7), hexamethylenediamine(tetramethylenephosphonate), potassium salt $C_{10}H(_{28}\text{-}x)N_2K_xO_{12}P_4$ (x=6), bis(hexamethylene)triamine(pentamethylenephosphonic acid) $(HO_2)POCH_2N[(CH_2)_6N[CH_2PO(OH)_2]_2]_2$, and phosphorus acid $H_3PO_3$. Exemplary amino-acetates include aminocarboxylic acids such as N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Enzyme

The present composition may include one or more enzymes, which can provide desirable activity for removal of protein-based, carbohydrate-based, or triglyceride-based soils from substrates such as flatware, cups and bowls, and pots and pans. Enzymes suitable for the inventive composition can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

A valuable reference on enzymes is "Industrial Enzymes," Scott, D., in Kirk-Othmer *Encyclopedia of Chemical Technology,* 3rd Edition, (editors Grayson, M. and EcKroth, D.) Vol. 9, pp. 173-224, John Wiley & Sons, New York, 1980.

Protease

A protease suitable for the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). Examples of proteolytic enzymes which can be employed in the present invention include (with trade names) Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Preferred commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like. A mixture of such proteases can also be used. For example, Purafect® is a preferred alkaline protease (a subtilisin) for use in detergent compositions of this invention having application in lower temperature cleaning programs, from about 30° C. to about 65° C.; whereas, Esperase® is an alkaline protease of choice for higher temperature detersive solutions, from about 50° C. to about 85° C. Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present stabilized enzyme cleaning compositions is preferably at least 80% homologous, preferably having at least 80% sequence identity, with the amino acid sequences of the proteases in these references.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for the composition of the present invention can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in the stabilized enzyme cleaning composition of the invention include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl® by Novo. A mixture of amylases can also be used.

Amylases suitable for the present invention include: I-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. A variant I-amylase employed in the present stabilized enzyme cleaning compositions is preferably at least 80% homologous, preferably having at least 80% sequence identity, with the amino acid sequences of the proteins of these references.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

A cellulase suitable for the present invention can be derived from a plant, an animal, or a microorganism. Preferably the cellulase is derived from a microorganism, such as a fungus or a bacterium. Preferred cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes that can be employed in the stabilized enzyme cleaning composition of the invention include those sold under the trade names Carezyme® or Celluzyme® by Novo, or Cellulase by Genencor; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

Naturally, mixtures of different cellulase enzymes can be incorporated into this invention. While various specific enzymes have been described above, it is to be understood that any cellulase which can confer the desired cellulase activity to the composition can be used and this embodiment of this invention is not limited in any way by specific choice of cellulase enzyme.

Lipases

A lipase suitable for the present invention can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the stabilized enzyme cleaning composition of the invention include those sold under the trade names Lipase P "Amano" or "Amano-P" by Amano Pharmaceutical Co. Ltd., Nagoya, Japan or under the trade name Lipolase® by Novo, and the like. Other commercially available lipases that can be employed in the present compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*.

A preferred lipase is sold under the trade name Lipolase® by Novo. Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

Naturally, mixtures of different lipase enzymes can be incorporated into this invention. While various specific enzymes have been described above, it is to be understood that any lipase which can confer the desired lipase activity to the composition can be used and this embodiment of this invention is not limited in any way by specific choice of lipase enzyme.

Additional Enzymes

Additional enzymes suitable for use in the present stabilized enzyme cleaning compositions include a cutinase, a peroxidase, a gluconase, and the like. Suitable cutinase enzymes are described in WO 8809367 A to Genencor. Known peroxidases include horseradish peroxidase, lignin-ase, and haloperoxidases such as chloro- or bromo-peroxidase. Peroxidases suitable for stabilized enzyme cleaning compositions are disclosed in WO 89099813 A and WO 8909813 A to Novo. Peroxidase enzymes can be used in combination with oxygen sources, e.g., percarbonate, perborate, hydrogen peroxide, and the like. Additional enzymes suitable for incorporation into the present stabilized enzyme cleaning composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the stabilized enzyme cleaning composition of the present invention can be derived from a plant, an animal, or a microorganism. Preferably the enzyme is derived from a microorganism. The enzyme can be purified or a component of an extract, and either wild type or variant (either chemical or recombinant).

Naturally, mixtures of different additional enzymes can be incorporated into this invention. While various specific enzymes have been described above, it is to be understood that any additional enzyme which can confer the desired enzyme activity to the composition can be used and this embodiment of this invention is not limited in any way by specific choice of enzyme.

Enzyme Stabilizing System

The enzyme stabilizing system of the present invention includes a mixture of carbonate and bicarbonate. The enzyme stabilizing system can also include other ingredients to stabilize certain enzymes or to enhance or maintain the effect of the mixture of carbonate and bicarbonate.

Stabilizing systems of certain cleaning compositions, for example medical or dental instrument or device stabilized enzyme cleaning compositions, may further include from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic. Since percarbonate or percarbonate, which have the ability to react with chlorine bleach, may be present in certain of the instant compositions in amounts accounted for separately from the stabilizing system, the use of additional stabilizers against chlorine, may, most generally, not be essential, though improved results may be obtainable from their use.

Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium percarbonate tetrahydrate, sodium percarbonate monohydrate and sodium percarbonate, as well as phosphate, condensed phosphate, acetate, benzoate, citrate, formate, lactate, malate, tartrate, salicylate, etc., and mixtures thereof can be used if desired.

In general, since the chlorine scavenger function can be performed by ingredients separately listed under better recognized functions, there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer that is unacceptably incompatible, as formulated, with other reactive ingredients. In relation to the use of ammonium salts, such salts can be simply admixed with the stabilized enzyme cleaning composition but are prone to adsorb water and/or liberate ammonia during storage. Accordingly, such materials, if present, are desirably protected in a particle such as that described in U.S. Pat. No. 4,652,392, Baginski et al.

Surfactant

The surfactant or surfactant mixture of the present invention can be selected from water soluble or water dispersible nonionic, semi-polar nonionic, anionic, cationic, amphoteric, or zwitterionic surface-active agents; or any combination thereof.

A typical listing of the classes and species of surfactants useful herein appears in U.S. Pat. No. 3,664,961 issued May 23, 1972, to Norris.

Nonionic Surfactants

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

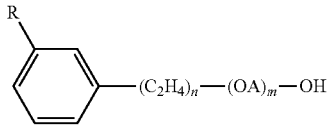

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule. The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$R^{20}$—$(PO)_sN$-$(EO)_tH$, $R^{20}$—$(PO)_sN$-$(EO)_tH(EO)_tH$, and $R^{20}$—$N(EO)_tH$;

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$R^{20}$—$(PO)_vN[(EO)_wH][(EO)_zH]$ in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

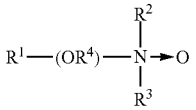

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

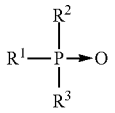

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

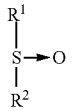

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Generally, however, anionics have high foam profiles which limit their use alone or at high concentration levels in cleaning systems such as CIP circuits that require strict foam control. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y− and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

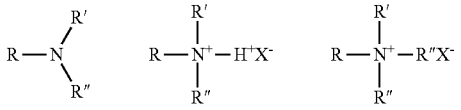

in which, R represents a long alkyl chain, R', R", and R"' may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1_m R^2_x Y_L Z$ wherein each $R^1$ is an organic group containing a straight or branched alkyl or alkenyl group optionally substituted with up to three phenyl or hydroxy groups and optionally interrupted by up to four of the following structures:

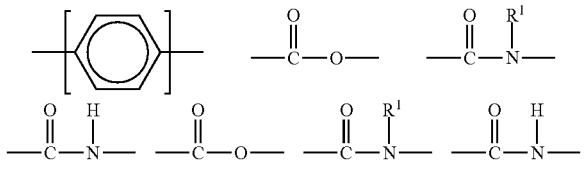

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group including, but not limited to:

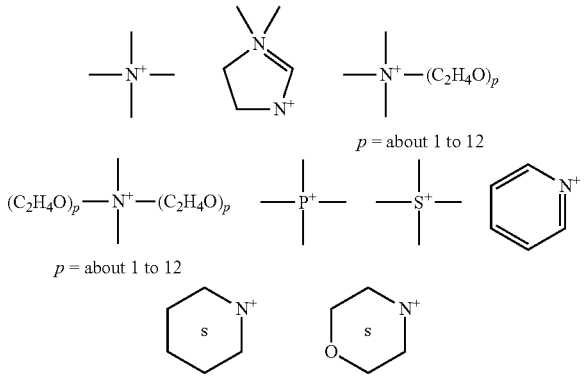

or a mixture thereof. Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," *Cosmetics & Toiletries*, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxyalkyl groups react to form a tertiary amine and an ether linkage with differing alkylating agents yielding different tertiary amines.

Long chain imidazole derivatives having application in the present invention generally have the general formula:

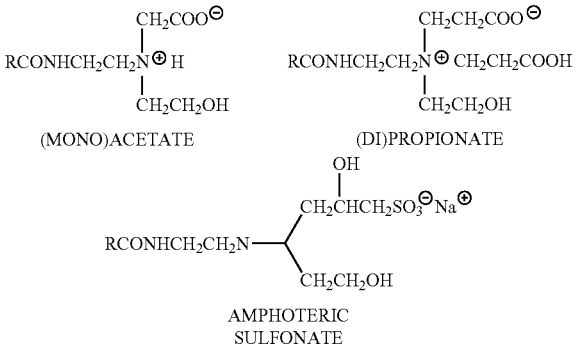

wherein R is an acyclic hydrophobic group containing from 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which $R=C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Di sodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

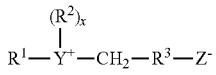

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

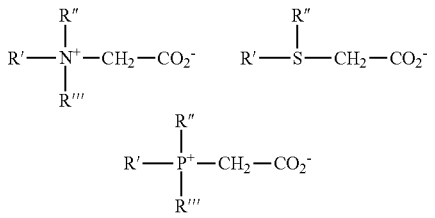

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Binding Agent

The composition may optionally include a binding agent to bind the detergent composition together to provide a solid detergent composition. The binding agent may be formed by mixing alkali metal carbonate, alkali metal bicarbonate, and water. The binding agent may also be urea or polyethylene glycol.

Antimicrobial Agent

Antimicrobial agents are chemical compositions that can be used in the composition to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population. Common antimicrobial agents include phenolic antimicrobials such as pentachlorophenol, orthophenylphenol. Halogen containing antibacterial agents include sodium trichloroisocyanurate, sodium dichloroisocyanurate (anhydrous or dihydrate), iodine-poly(vinylpyrolidin-onen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition.

Bleaching Agent

Bleaching agents for use in inventive formulations for lightening or whitening a substrate, include bleaching compounds capable of liberating an active halogen species, such as $Cl_2$, $Br_2$, —$OCI^-$ and/or —$OBr^-$, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochlorarrine and dichloramine, and the like. Encapsulated bleaching sources may also be used to enhance the stability of the bleaching source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1-10 wt. %, preferably about 1-6 wt. %.

Defoaming Agent/Foam Inhibitor

The composition of the invention may include a defoaming agent or a foam inhibitor. A defoaming agent or foam inhibitor may be included for reducing the stability of any foam that is formed. Examples of foam inhibitors include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Antiredeposition Agent

The composition may also include an antiredeposition agent capable of facilitating sustained suspension of soils in a cleaning solution and preventing the removed soils from being redeposited onto the substrate being cleaned. Examples of suitable antiredeposition agents include fatty acid amides, complex phosphate esters, styrene maleic anhydride copolymers, and cellulosic derivatives such as hydroxyethyl cellulose, hydroxypropyl cellulose, and the like.

Dye or Odorant

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as ClS-jasmine or jasmal, vanillin, and the like.

Hydrotrope

The compositions of the invention may optionally include a hydrotrope, coupling agent, or solubilizer that aides in compositional stability, and aqueous formulation. Functionally speaking, the suitable couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents for use in the present invention include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or-terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides.

Carrier

The composition may optionally include a carrier or solvent. The carrier may be water or other solvent such as an alcohol or polyol. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g. propylene glycol, ethylene glycol, glycerine, and 1,2-propanediol) can also be used.

Acidic Composition

The method of the present invention includes at least one acidic step wherein an acidic composition is brought into contact with a dish during the acidic step of the cleaning process. The acidic composition includes one or more acids. Both organic and inorganic acids have been found to be generally useful in the present composition. Organic acids useful in accordance with the invention include hydroxyacetic (glycolic) acid, citric acid, formic acid, acetic acid, propionic acid, butyric acid, valeric acid, caproic acid, gluconic acid, itaconic acid, trichloroacetic acid, urea hydrochloride, and benzoic acid, among others. Organic dicarboxylic acids such as oxalic acid, malonic acid, succinic acid, glutaric acid, maleic acid, fumaric acid, adipic acid, and terephthalic acid among others are also useful in accordance with the invention. Any combination of these organic acids may also be used intermixed or with other organic acids which allow adequate formation of the composition of the invention. Inorganic acids useful in accordance with the invention include phosphoric acid, sulfuric acid, sulfamic acid, methylsulfamic acid, hydrochloric acid, hydrobromic acid, hydrofluoric acid, and nitric acid among others. These acids may also be used in combination with other inorganic acids or with those organic acids mentioned above. An acid generator may also be used in the composition to form a suitable acid. For example, suitable generators include calcium phosphate, potassium fluoride, sodium fluoride, lithium fluoride, ammonium fluoride, ammonium bifluoride, sodium silicofluoride, etc. In one embodiment, the acid is preferably phosphoric. In another embodiment, the acid is preferably a mixture of citric acid and sulfamic acid. A mixture of citric acid and sulfamic acid is especially good when hard water is used because it does not create precipitates. The acid is preferably present in the diluted, ready to use, acidic composition from about 0.01 wt. % to about 1 wt. %, more preferably from about 0.25 wt. % to about 0.5 wt. % and most preferably from about 0.05 wt. % to about 0.05 wt. %. The acidic composition preferably creates a diluted solution having a pH from about 0 to about 7, more preferably from about 1 to about 5, and most preferably from about 2 to about 4. The particular acid selected is not as important as the resulting pH. Any acid that achieves the desired pH may be used in the acidic composition of the invention.

The acidic composition may include additional ingredients. For example, the acidic composition may include an anticorrosion agent, a water conditioning agent, a surfactant, an enzyme, an enzyme stabilizing system, a foam inhibitor/defoaming agents, an anti-etch agent, a bleaching agent, a dye or odorant, an antimicrobial agent, a hydrotrope, a binding agent, a carrier and mixtures thereof. The water conditioning agent, enzyme, enzyme stabilizing system, surfactant, bleaching agent, dye or odorant, antimicrobial agent, hydrotrope, antiredeposition agent, binding agent, and carrier may be selected from any those compositions previously described herein.

Surfactant

In addition to the surfactants previously described, it has been discovered that it is advantageous to put a nonionic surfactant and/or a cationic surfactant into the acidic composition.

A nonionic surfactant, when included in the acidic composition and used in the method of the invention has been found to assist in preventing the formation of spots as well as assisting in the prevention of redeposition soils. The nonionic surfactant also helps in the removal or soils. A preferred nonionic surfactant is a low foaming nonionic surfactant such as Pluronic N-3, commercially available from BASF.

A cationic surfactant, when included in the acidic composition and used in the method of the invention has been found to assist in the removal of protein. Examples of preferred cationic surfactants are found in U.S. Pat. No. 6,218,349, which is hereby incorporated by reference in its entirety. The cationic surfactant is preferably diethylammonium chloride, commercially available as Glensurf 42 from Glenn Chemical (St. Paul, Minn.).

Anti-Etch Agent

The composition may also include an anti-etch agent capable of preventing etching in glass. Examples of suitable anti-etch agents include adding metal ions to the composition such as zinc, zinc chloride, zinc gluconate, aluminum, and beryllium.

Anticorrosion Agent

The composition may optionally include an anticorrosion agent. Anticorrosion agents provide compositions that generate surfaces that are shiner and less prone to biofilm buildup than surfaces that are not treated with compositions having anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a dish machine.

Rinse

As previously discussed, the method may optionally include a rinse step. The rinse step may take place at any time during the cleaning process and at more than one time during the cleaning process. The method preferably includes one rinse at the end of the cleaning process.

The rinse composition may comprise a formulated rinse aid composition containing a wetting or sheeting agent combined with other optional ingredients. The rinse aid components is a water soluble or dispersible low foaming organic material capable of reducing the surface tension of the rinse water to promote sheeting action and to prevent spotting or streaking caused by beaded water after rinsing is complete in warewashing processes. Such sheeting agents are typically organic surfactant like materials having a characteristic cloud point. The cloud point of the surfactant rinse or sheeting agent is defined as the temperature at which a 1 wt. % aqueous solution of the surfactant turns cloudy when warmed. Since there are two general types of rinse cycles in commercial warewashing machines, a first type generally considered a sanitizing rinse cycle uses rinse water at a temperature of about 180.degree. F., about 80.degree. C. or higher. A second type of non-sanitizing machines uses a lower temperature non-sanitizing rinse, typically at a temperature of about 125.degree. F., about 50.degree. C. or higher. Surfactants useful in these applications are aqueous rinses having a cloud point greater than the available hot service water. Accordingly, the lowest useful cloud point measured for the surfactants of the invention is approximately 40.degree. C. The cloud point can also be 60.degree. C. or higher, 70.degree. C. or higher, 80.degree. C. or higher, etc., depending on the use locus hot water temperature and the temperature and type of rinse cycle. Preferred sheeting agents, typically comprise a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly (EO), poly PO or random polymerized regions can be formed in the molecule. Particularly useful polyoxypropylene polyoxyethylene block copolymers are those comprising a center block of polyoxypropylene units and blocks of polyoxyethylene units to each side of the center block. Such polymers have the formula shown below:

$$(EO)n\text{-}(PO)m\text{-}(EO)n$$

wherein n is an integer of 20 to 60, each end is independently an integer of 10 to 130. Another useful block copolymer are block copolymers having a center block of polyoxyethylene units and blocks of polyoxypropylene to each side of the center block. Such copolymers have the formula:

(PO)n-(EO)m-(PO)n wherein m is an integer of 15 to 175 and each end are independently integers of about 10 to 30. The solid functional materials of the invention can often use a hydrotrope to aid in maintaining the solubility of sheeting or wetting agents. Hydrotropes can be used to modify the aqueous solution creating increased solubility for the organic material. Preferred hydrotropes are low molecular weight aromatic sulfonate materials such as xylene sulfonates and dialkyldiphenyl oxide sulfonate materials. Bleaching agents for use in inventive formulations for lightening or whitening a substrate, include bleaching compounds capable of liberating an active halogen species, such as Cl2, Br2, —OCl— and/or —OBr—, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochloramine and dichloroamine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like.

Dish Machines

The method of the invention may be carried out in any consumer or institutional dish machine. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines. In a preferred embodiment, the dish machine is made out of acid resistant material, especially when the portions of the dish machine that contact the acidic composition do not also contact the alkaline composition.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The method of the invention may be used in conjunction with any of the door machines described above. When the method of the invention is used in a door machine, the door machine may need to be modified to accommodate the acidic step. The door machine may be modified in one of several ways. In one embodiment, the acidic composition may be applied to the dishes using the rinse spray arm of the door machine. In this embodiment, the rinse spray arm is connected to a reservoir for the acidic composition. The acidic composition may be applied using the original nozzles of the rinse arm. Alternatively, additional nozzles may be added to the rinse arm for the acidic composition. In another embodiment, an additional rinse arm may be added to the door machine for the acidic composition. In yet another embodiment, spray nozzles may be installed in the door machine for the acidic composition. In a preferred embodiment, the nozzles are installed inside the door machine in such a way as to provide full coverage to the dish rack.

FIG. 1 shows a door dish machine modified to provide the acid through the rinse arm of the dish machine. The dish machine (1) consists of a housing frame (3) provided with support legs (2). In the housing frame (3) there is arranged a first tank (4) for an alkaline cleaning solution. This alkaline cleaning solution is sucked out of the tank (4) using a pump (not shown) fed by means of pipe ducts (5) under pressure to spray nozzles (6) of an upper spray arm (17) and a lower spray arm (18) and sprayed onto the dishes disposed in the upper part of the door dish machine (1). After a pause, heated rinse water from boiler (13) is sprayed over an upper rinse arm (10) and a lower rinse arm (12). In order to be able to introduce soiled dishes into the dish machine (1) and remove cleaned dishes again from the dish machine (1), the dish machine (1) has in its upper part a door pivotable in the direction of the arrow (7) or a pivotable housing part (8). This pivotable housing part (8) is to be pivoted by means of a handgrip (9) by the user upwardly for opening and downwardly again for closing into the position illustrated in the figures. In area (11) the pivotable housing part (8) overlaps the housing frame part (3) in closed position. According to the embodiment of FIG. 1, the boiler (13) is connected to the rinse arm (10) and (12) by additional pipe ducts (14). Acid from a container (not shown) can be pumped with a pump (15). Via this pipe ducts (14) and the pump (15), acidic cleaning solution and water from boiler (13) can be transported to the nozzles (6) of the rinse arms (10) and (12). The rinse arms (10) and (12) and all the pipes (14) are so constructed that the rinse arms (10) and (12) are optionally connected only to the boiler (13) for rinsing or to the boiler (13) and the pump (15) for the acidic cleaning solution. So it is possible to alternatively spray rinse water or acidic cleaning solution on the dishes.

Figure 2:
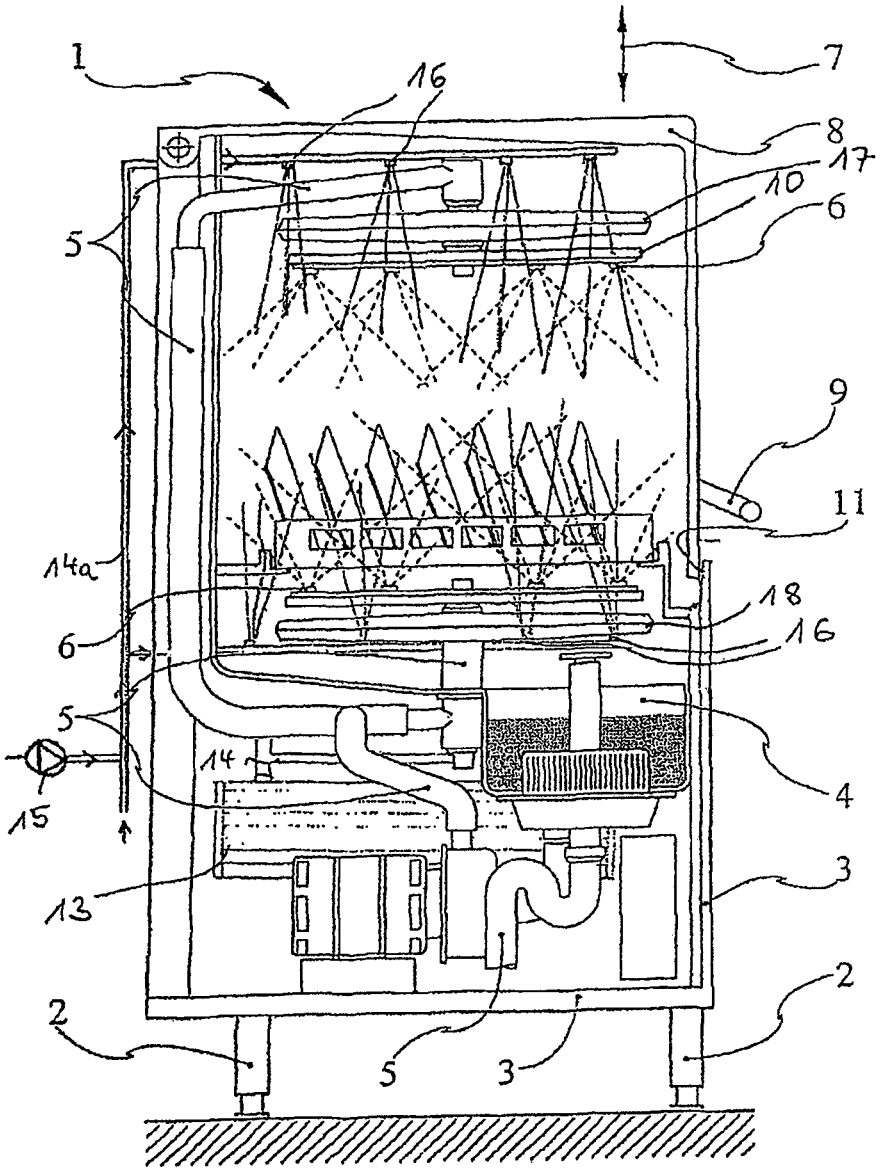
FIG. 2 shows a door dish machine where the acid is applied through spray nozzles mounted on the top and bottom of the dish machine.

FIG. 2 shows a door dish machine where the acid is applied through spray nozzles mounted on the top and bottom of the dish machine. In FIG. 2, the additional nozzles (16) in the top and bottom area of the dish machine (1) above and beneath the spray arms (17) and (18) are mounted. These nozzles (16) are connected to the pump (15) via further pipe ducts (14*a*) (diluted with water). In this way, it is possible to spray the acidic cleaning solution over the nozzles (16).

Figure 3:
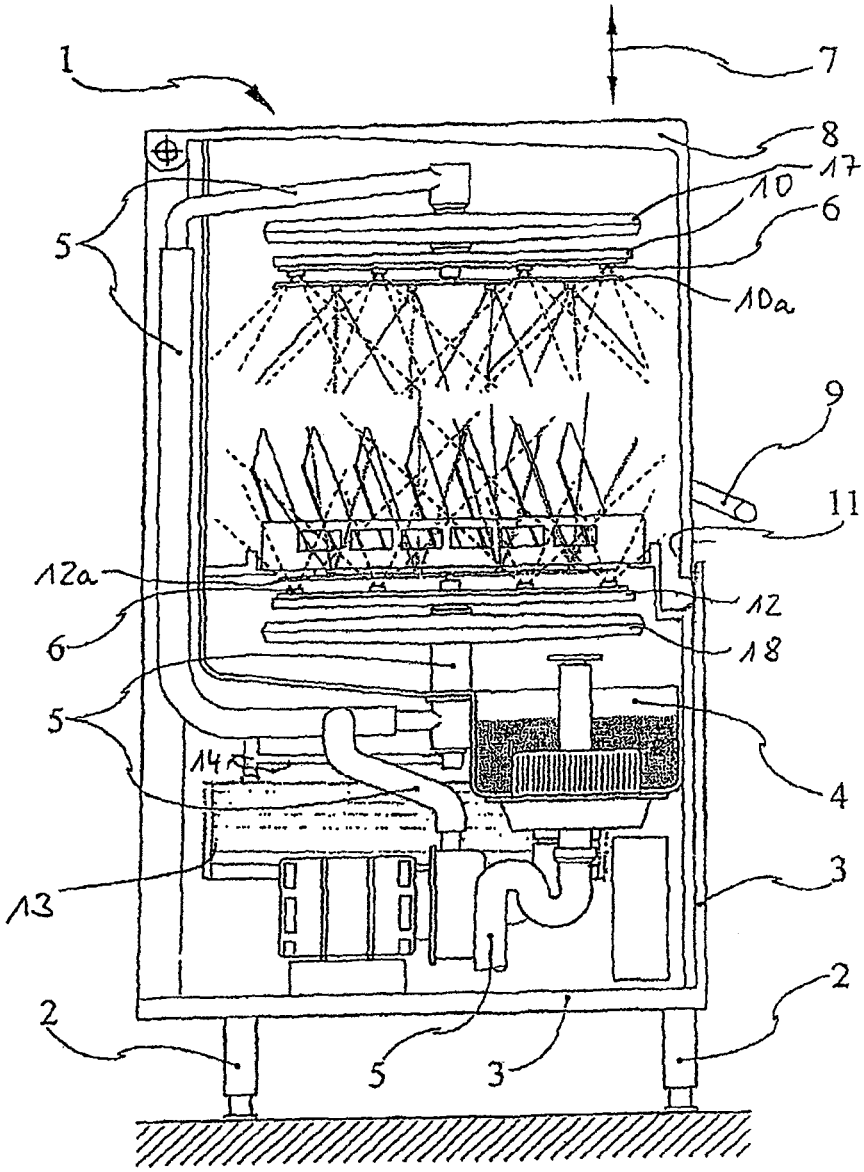
FIG. 3 shows a door dish machine where the acid is applied through a separate rinse arm.

FIG. 3 shows a door dish machine where the acid is applied through a separate rinse arm. In FIG. 3, the boiler (13) is connected to rinse arms (10) and (12) and to additional rinse arms (10*a*) and (12*a*). The additional upper rinse arm (10*a*) is arranged close to the rinse arm (10) and the additional lower rinse arm (12*a*) close to the lower rinse arm (12). These additional rinse arms (10*a*) and (12*a*) are connected with the boiler (13) and the pump (not shown) for the acid. Here, the alkaline cleaning solution from tank (4) is sprayed over the spray arms (17) and (18) whereby the acidic cleaning solution is sprayed over the additional rinse arms (10*a*) and (12*a*) and the rinse solution over the rinse arms (10) and (12).

Figure 4:
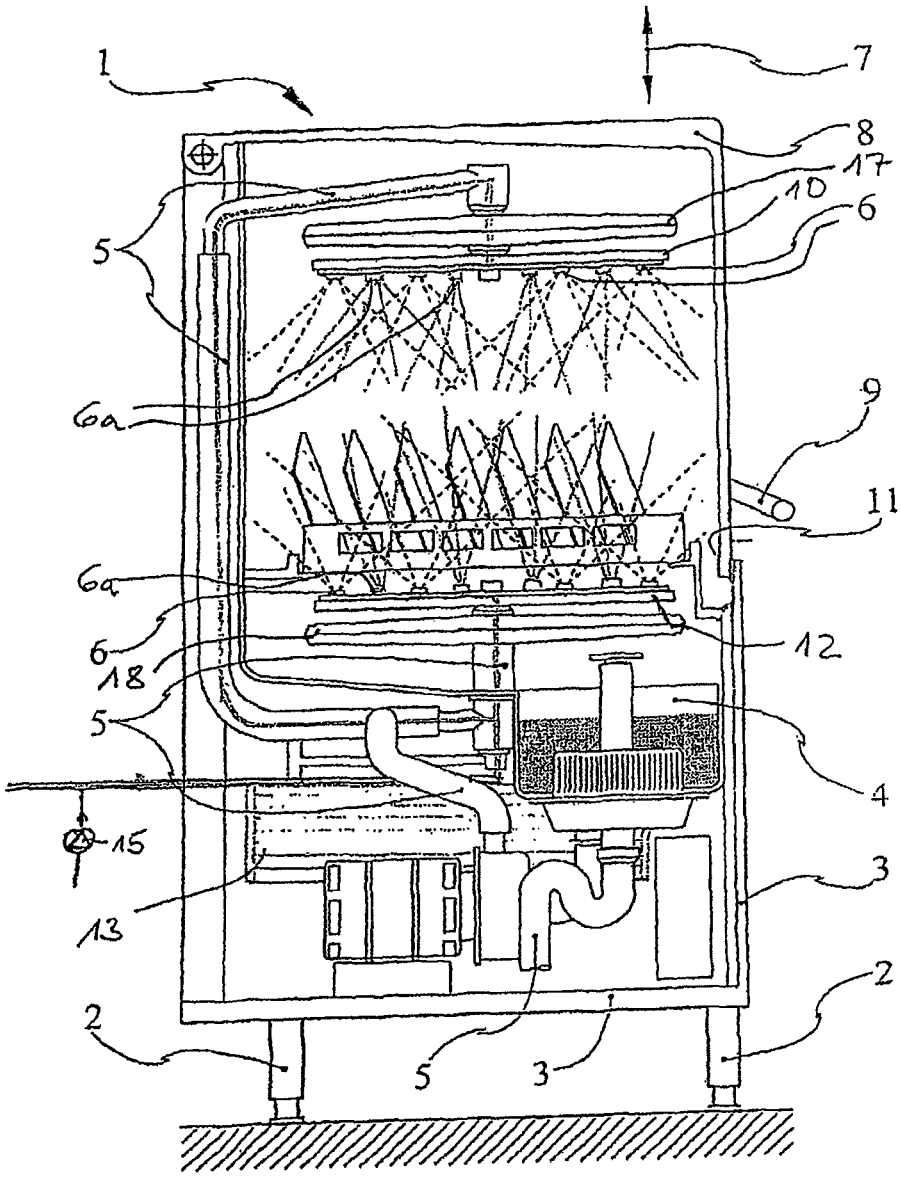
FIG. 4 shows a door dish machine where the acid is applied through additional nozzles in the rinse arm.

FIG. 4 shows a door dish machine where the acid is applied through additional nozzles (6*a*) in the rinse arm. The additional nozzles (6*a*) are connected with a water supply and a pump (15) for dosing the acid. The other nozzles (6) are connected with the boiler (13). In this case the rinse solution is sprayed over nozzles (6) of rinse arms (10) and (12) and the acidic cleaning solution over nozzles (6*a*).

Figure 5:
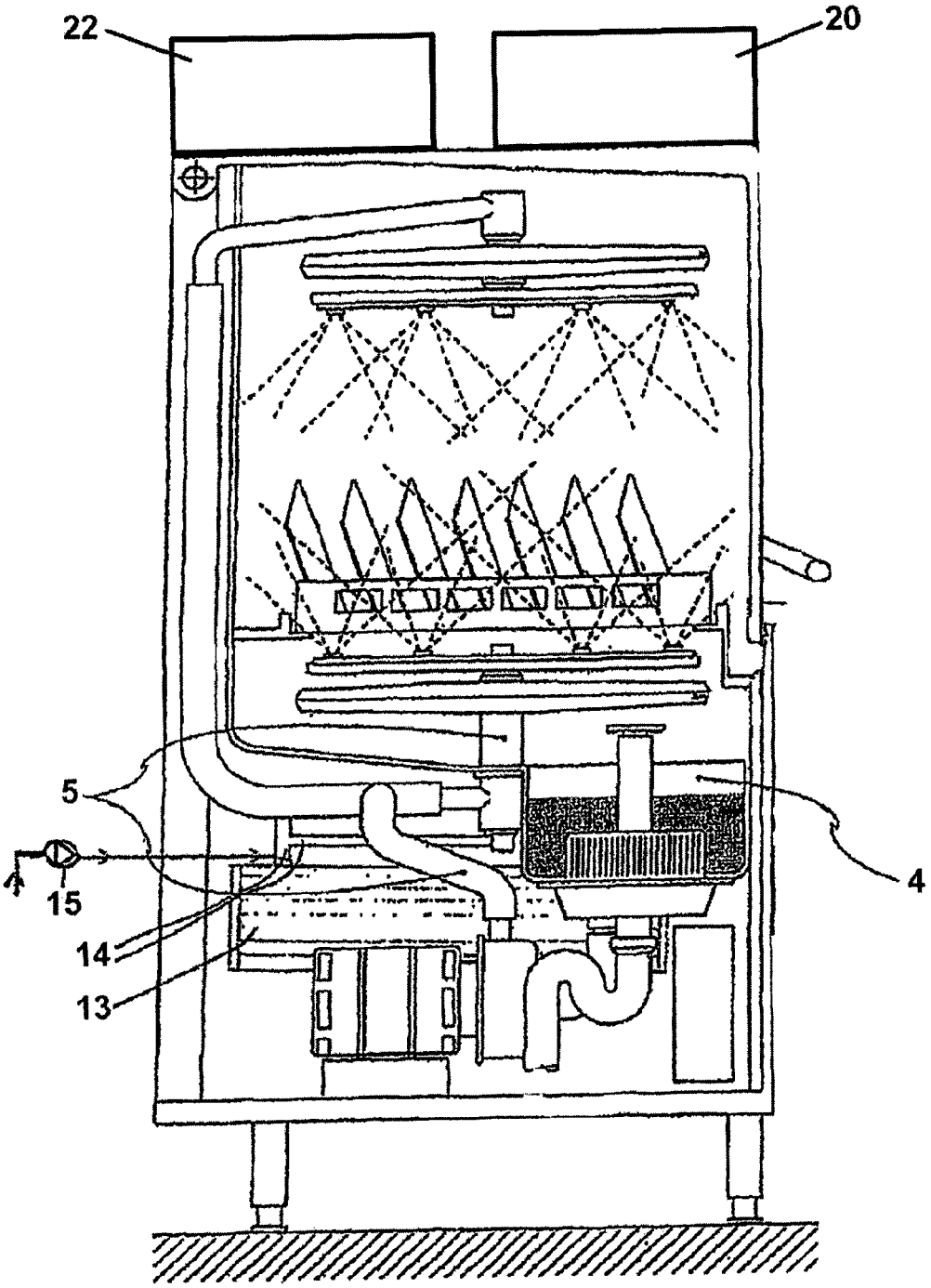
FIG. 5 shows a door dish machine with a first and second chemical dispenser located on the exterior of the dish machine.

FIG. 5 shows the exemplary door dish machine of FIG. 1 with a first chemical dispenser 20 and a second chemical dispenser 22 located on the exterior of the dish machine. The first dispenser 20 is in fluid communication with the wash arms or the first tank, and the second dispenser 22 is in fluid connection with the rinse arms, nozzles or the second tank.

In one preferred embodiment, the door machine is modified by applying the acidic composition through the rinse arm of the door machine. This embodiment is advantageous because it requires less installation than if additional nozzles are added to the rinse arm or if spray nozzles are added to the interior of the door machine. In another preferred embodiment, the door machine if modified by adding spray nozzles to the interior of the door machine. This embodiment is advantageous because it requires less water than when the acidic composition is applied through the rinse arm.

In addition to modifying the door machine, the door machine controller will also need to be modified to include the acidic step.

The method of the invention may also be used in a pot and pan and a utensil washer. Here the pot and pan and utensil washer are modified the same as the door machine. A conveyor machine refers to a commercial dish machine, wherein the soiled dishes are placed on a rack that moves through a dish machine on a conveyor. A conveyor machine continuously cleans racks of soiled dishes instead of one rack at a time. Here the manifolds are typically stationary or oscillating and the rack moves through the machine.

A conveyor machine may be a single tank or multi-tank machine. The conveyor machine may include a prewash section. A conveyor machine may be a high temperature or low temperature machine. Finally, conveyor machines primarily recirculate the detergent solution. Some non-limiting examples of conveyor machines include the Ecolab ES-4400, the Jackson AJ-100, the Stero SCT-44, and the Hobart C-44, and C-66

The method of the invention may be used in conjunction with any of the conveyor machines described above. When the method of the invention is used in a conveyor machine, the conveyor machine may need to be modified to accommodate the acidic step. The conveyor machine may be modified by adding spray nozzles for the acidic step between tanks for the alkaline steps. The nozzles for the acidic step are connected to an acidic composition source. The placement of the nozzles in the conveyor machine may be adjusted to provide for the application of the acidic composition at the desired time. The acidic composition may also be applied by running the acid through a wash arm.

An undercounter machine refers to a dish machine similar to most consumer dish machines, wherein the dish machine is located underneath a counter and the dishes are cleaned one rack at a time. In an undercounter dish machine, the rack is stationary and the wash/rinse arms are moving. Undercounter machines may be a high temperature or low temperature machine. The undercounter machine may either be a recirculation machine or a dump and fill machine. Some non-limiting examples of undercounter machines include the Ecolab ES-1000, the Jackson JP-24, and the Hobart LX-40H.

The method of the invention may be used in conjunction with any of the undercounter machines described above. When the method of the invention is used in a undercounter machine, the undercounter machine may need to be modified to accommodate the acidic step, or the cleaning compositions be modified. The undercounter machine may be modified to discard the washing water between steps and refill with fresh water. In this case the amount of cleaning agent can be lower because less will be needed to achieve the desired pH. When the washing water is not discarded between steps, the amount of cleaning agent necessary will increase because more will be needed to bring the pH to the desired level. The undercounter machine may also be modified by adding additional dosing chambers that may either be time or pressure activated.

Consumer dish machine may be modified in a way similar to the undercounter machines.

Undercounter and consumer machines are especially suited to use with a tablet.

Glasswashers may also be used with the method of the invention. Undercounter glasswashers will be modified like an undercounter dish machine. Bar glass washers that utilize a rotary drive may be modified by incorporating additional spray nozzles and detergent reservoirs for the acid step and the second alkaline step. In addition, the wash cycle may be slowed down to accommodate the method of the invention.

A flight machine refers to a commercial dish machine, wherein the soiled dishes are placed on pegs that move through a dish machine on a conveyor. A flight machine continuously cleans soiled dishes and racks are not used. Here the manifolds are typically stationary or oscillating and the conveyor moves through the machine.

A flight machine is typically a multi-tank machine. The flight machine may include a prewash section. A flight machine is typically a high temperature machine. Finally, flight machines typically recirculate the detergent solution. Some non-limiting examples of flight machines include the Meiko BA Series and the Hobart FT-900.

The method of the invention may be used in conjunction with any of the flight machines described above. When the method of the invention is used in a flight machine, the flight machine may also need to be modified to accommodate the acidic step. The flight machine may be modified by adding spray nozzles for the acidic step between tanks for the alkaline steps. The nozzles for the acidic step are connected to an acidic composition source. The placement of the nozzles in the flight machine may be adjusted to provide for the application of the acidic composition at the desired time. The acidic composition may also be applied by running the acid through a wash arm.

The above described dish machines include dispensers for dispensing the alkaline cleaning agent and the acidic cleaning agent. The dispenser may be selected from a variety of dispensers depending on the physical form of the composition. For example, a liquid composition may be dispensed using a pump, either peristaltic or bellows for example, syringe/plunger injection, gravity feed, siphon feed, aspirators, unit dose, for example using a water soluble packet such as polyvinyl alcohol or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example, using a water soluble packet such as polyvinyl alcohol or a foil pouch, evacuation from a pressurized chamber, or diffusion through a membrane or permeable surface. Finally, if the composition is a solid or powder, the composition may be dispensed using a spray, flood, auger, shaker, tablet-type dispenser, unit dose using a water soluble packet such as polyvinyl alcohol or foil pouch, or diffusion through a membrane or permeable surface. The dispenser may also be a dual dispenser in which the alkaline cleaning agent is dispensed on one side, and the acidic cleaning agent is dispensed on the other side. These dispensers may be located in the dish machine, outside of the dish machine, or remote from the dish machine. Finally, a single dispenser may feed one or more dish machines.

It is understood that the dish machines described herein may be used in conjunction with the method of the invention. Additionally, the dish machines may be modified as described and used with a different method of cleaning. For example, instead of using the method of the invention in a dish machine modified according to this invention, a different detergent, for example, a special surfactant package, rinse aid, or the like, may be run through the modified dish machine, for example through the additional wash or rinse arms, or spray nozzles.

While not wanting to be held to any scientific theory, it is believed that the first alkaline wash causes the starch soil to swell and partially dissolve. The addition of the acidic composition hydrolyzes the glycosidic linkages and depolymerizes the starch. Finally, the second alkaline wash loosens any remaining soil.

For a more complete understanding of the invention, the following examples are given to illustrate some embodiment. These examples and experiments are to be understood as illustrative and not limiting. All parts are by weight, except where it is contrarily indicated.

EXAMPLES

The following chart provides a brief explanation of certain chemical components used in the following examples:

TABLE 1

Trade Names and Corresponding Descriptions of Some Chemicals Used in the Examples

| Trademark/Chemical Name | Description | Provider |
|---|---|---|
| Solid Power | Caustic alkaline detergent | Ecolab Inc. |
| Solid Fusion | Carbonate based alkaline detergent | Ecolab Inc. |
| Acidic Detergent | Alkaline detergent 95 wt. % phosphoric acid (75%) and 5% wt. % of a $C_{12}$-$C_{14}$, 12 mole ethoxylate, benzyl capped nonionic surfactant | Ecolab Inc. |
| Vitech BJS-1 | 60% urea hydrochloride | Vitech International Inc. |
| Perclin Intensive Flussig | Caustic alkaline detergent | Ecolab Inc. |
| Ultra Klene | Caustic alkaline detergent | Ecolab Inc. |
| FX-3 | Sulfamic Acid and Citric Acid | Ecolab Inc. |
| Topmat Tab | Alkaline agent and enzyme | Ecolab Inc. |
| Pluronic N-3 | Nonionic surfactant | BASF |
| Glensurf 42 | Cationic surfactant | Glenn Corp. |
| Omega Solid Rinse Aid | Rinse Aid | Ecolab Inc. |
| Omega solid Detergent | Carbonate based alkaline detergent | Ecolab Inc. |
| Ultra Dry | Rinse Aid | Ecolab Inc. |

Corn Starch Soiling Procedure

Some of the following examples tested cleaning performance on plates soiled with corn starch. To prepare the plates, 30 grams of corn starch and 1 ml of Luconyl black dye were added to 500 grams of water while stirring. The corn starch solution was brought to boiling and then cooled to 75° C. Approximately 4 grams of the corn starch solution was applied to a plate using a brush. The plates were allowed to cure, either overnight, or using an oven. When the plates were cured in an oven, the resulting starch soil was harder than if the plates were cured overnight.

Cleaning performance was evaluated visually by examining the amount of gross soils, or heavy black solids, and gray film removed.

Example 1

Example 1 tested the impact on starch removal of an acidic composition versus other non-acidic compositions when used according to the method of the invention. For this test, plates were prepared according to the corn starch soiling procedure.

The plates were put through a cleaning process in a Krefft® single-tank dish machine according to the following method: (1) the plates were cleaned for one minute with a 0.3 wt. % aqueous solution of a standard alkaline detergent (approximately 17 wt. % alkali metal hydroxide, 14 wt. % tripolyphosphate, 1.5 wt. % alkali metal hypochlorite, 1 wt. % alkali silicate, and the remainder water); (2) the plates were then sprayed with one of the six solutions described in Table 2; (3) the sprayed on solution was allowed to sit for 30 seconds; and (4) the alkaline detergent in step (1) was applied again for two minutes. Soft water was used in this example. The cleaning temperature of the Krefft® machine was 140° F. (60° C.). This procedure was repeated for each solution described in Table 2. The plates were evaluated on a visual scale of 1 to 10 where 1 stands for no visible sign of cleaning and 10 stands for complete removal of soil.

TABLE 2

Impact of an Acidic Cleaning Step on Performance

| Test | Spray-On Solution | Evaluation of Cleaning Performance |
|---|---|---|
| 1 | 1% NaOH | 4.6 |
| 2 | 0.3 g/l Perzym (enzyme containing product) | 1.2 |
| 3 | 0.4 wt. % methanesulfonic acid | 9.0 |
| 4 | 0.7 wt. % methanesulfonic acid | 9.5 |
| 5 | 1 wt. % methanesulfonic acid | 9.5 |
| 6 | Water | 1.2 |

Table 2 shows that the best cleaning results were achieved in tests 3-5 where a solution of methanesulfonic acid was used as the spray-on solution. Tests 3-5 altered the pH from alkaline to acid and back to alkaline, whereas test 1 used an alkaline composition, test 2 used an enzyme, and test 6 used water.

Table 2 also shows that a high acid concentration is not necessary in order to achieve results. As demonstrated in test 3, an acidic composition of 0.4 wt. % is effective at removing starch when used according to the method described in this invention.

Example 2

Example 2 tested the ability of the method of the invention to perform in a modified door dish machine. For this example, a standard door dish machine (Krefft® Professional Plus) was modified by adding an additional injection point. Also, the dish machine's program was altered from an alkaline cleaning—pause—rinse step to alkaline cleaning—pause—acidic rinse—pause—alkaline cleaning.

For this test, plates were prepared according to the corn starch soiling procedure. The alkaline detergent used in this example for the first alkaline step and the second alkaline step was 3 g/l of Perclin Intensive Flussig. The plates were evaluated on a visual scale of 0 to 10 where 0 stands for no visible sign of cleaning and 10 stands for complete removal of soil.

TABLE 3

Cleaning Performance in a Door Dish Machine

| Test | Water Type | No. of Cycles | First Alkaline Step Time | Pause (Sec.) | Acidic Step Detergent | Pause (Sec.) | Second Alkaline Step Time | Evaluation of Cleaning Performance | Total Time |
|---|---|---|---|---|---|---|---|---|---|
| 1 | Soft | 1 | 1 min. | 10 | Water | 30 | 2 min. | 3.5 | 2.50 min. |
| 2 | Soft | 1 | 1 min. | 10 | 0.25% $H_3PO_4$ | 30 | 2 min. | 9.9 | 2.50 min. |
| 3 | Soft | 1 | 1 min. | 10 | 0.18% $H_3PO_4$ | 30 | 2 min. | 9.9 | 2.50 min. |
| 4 | Soft | 1 | 1 min. | 10 | 0.08% $HNO_3$ | 30 | 2 min. | 9.9 | 2.50 min. |
| 5 | Hard | 2 | 16 sec. | 4 | 0.18% $H_3PO_4$ | 10 | 16 sec. | 7.7 | 106 sec. |
| 6 | Hard | 2 | 16 sec. | 4 | Water | 10 | 16 sec. | 1.0 | 106 sec. |

Table 3 shows that including an acidic step in the method of the invention is more effective at removing starch than when water is used instead of the acid. Also, Table 3 shows that the method of the invention is effective at removing starch when used in a door dish machine. Tests 1 and 6 used water instead of the acid. When water was used in the long cleaning process (Test 1) and the short, two cycle cleaning process (Test 6), the starch was not effectively removed.

Example 3

Example 3 tested the performance of a tablet in a consumer dish machine. A glass tube was filled with six different layers to form the "tablet." The first layer was 5.3 grams of NaOH. The second layer was a paraffin layer with a melting point from 134° F. (57° C.) to 140° F. (60° C.). The third layer contained 10.0 grams of amidosulfonic acid. The fourth layer was another paraffin layer with a melting point from 124° F. (51° C.) to 127° F. (53° C.). The fifth layer was 1.0 grams of NaOH. Finally, the sixth layer contained a paraffin layer with a melting point of 95° F. (35° C.). Alternatively, a polyethylene glycol having a molecular weight of about 8000 can be used to close the tube. This glass tube was placed in a Bosch SMS 2022 household dishwasher such that the polyalkylene glycol layer would dissolve first, and the 5.3 grams of NaOH would dissolve last. The composition of the layers was designed to correspond to the temperature of the dish machine's wash cycle so that as the temperature of the wash cycle changed, the individual layers dissolved in the appropriate sequence to provide an alkaline cleaning step, then an acidic cleaning step, and then an alkaline cleaning step. The machine was run using Program 3 and the program of the machine was not modified. For this test, plates were prepared according to the corn starch soiling procedure.

The first alkaline cleaning step was at a temperature from about 68° F. (20° C.) to 127° F. (53° C.). The 1.0 gram of NaOH was dissolved in 5.251 liters of water. The pH of the solution was 11 at 68° F. (20° C.) and 10.5 at 127° F. (53° C.). The first alkaline cleaning step lasted approximately seven minutes. During the acidic cleaning step, the temperature ranged from 127° F. (53° C.) to 140° F. (60° C.). The 10 grams of amidosulfonic acid was dissolved in 5.251 liters of water. The pH of the solution was 2. The acidic cleaning step lasted approximately 2 minutes. The second alkaline cleaning step had a temperature from 140° F. (60° C.) to 156° F. (69° C.). The 5.3 grams of NaOH was dissolved in 5.251 ml of water. The pH of the solution was 11 at 140° F. (60° C.) and 10.8 at 156° F. (69° C.). The second alkaline cleaning step lasted approximately 13 minutes. The second alkaline cleaning step was followed by a regular rinse.

The performance of the glass tube compositions was tested against Topmat Tab. The plate were evaluated on a visual scale of 0 to 10 where 0 stands for no visible sign of cleaning and 10 stands for complete removal of soil. The results are described in Table 4.

TABLE 4

Performance of a Detergent Tablet in a Consumer Dish Machine

| Tablet | Results |
|---|---|
| Experimental Tablet | 9-10 |
| Topmat Tab | 3-5 |

As shown in Table 4, the experimental tablet had a cleaning performance of from 9 to 10. In contrast, the Topmat Tab had a cleaning performance of from 3-5. Thus, the experimental tablet of the present invention is capable of providing superior removal of starch compared to the prior art.

Example 4

Example 4 tested the impact of an acidic composition versus other non-acidic compositions when used according to the method of the invention. For this test, plates were prepared according to the corn starch soiling procedure. The plates were put through a cleaning process in a Hobart AM-14 door dish machine. The cleaning temperature of the AM-14 machine was 145° F. (63° C.).

TABLE 5

Impact of Acidic Cleaning on Performance

| | | First Step | | Second Step | | Third Step | | |
|---|---|---|---|---|---|---|---|---|
| Test | pH | Detergent | Time (min.) | Detergent | Time (min.) | Detergent | Time (min.) | Results |
| 1 | 11.7 | 1000 ppm Solid Power | 1 | No Detergent (Pause) | 1 | 1000 ppm Solid Power | 1 | Most of the starch was removed except under the rim at the top. A gray film remained on all the glasses. |
| 2 | 12.0 | 1000 ppm Solid Power | 1 | 1% HCl | 1 | 1000 ppm Solid Power | 1 | Most of the starch soil removed with no starch film. |
| 3 | 11.8 | 1000 ppm Solid Power | 1 | No Detergent (Pause) | 1 | 1000 ppm Solid Power | 1 | Most of the starch was removed except under the rim at the top. A gray film remained on all the glasses. |
| 4 | 11.7 | 1000 ppm Solid Power | 1 | 1% HCl | 1 | 1000 ppm Solid Power | 1 | Most of the starch soil removed with no starch film. |
| 5 | 11.8 | 1000 ppm Solid Power | 1 | 1% NaOH | 1 | 1000 ppm Solid Power | 1 | Some soil remained with a starch film. |
| 6 | 8.7 | Water (pH = 8.1) | 1 | No Detergent (Pause) | 1 | Water (pH = 8.1) | 1 | Very little soil removal. |
| 7 | 2.6 | 1000 ppm Acidic Detergent | 1 | No Detergent (Pause) | 1 | 1000 ppm Acidic Detergent | 1 | Virtually no cleaning. |

Table 5 shows that the best cleaning results were achieved in tests 2 and 4 where hydrochloric acid was used. The concentrated NaOH spray (test 5) improved detergent performance from just Solid Power® (tests 1 and 3) but was not nearly as effective as the acid spray (tests 2 and 4). The acid detergent alone (test 7) was less effective than water (test 6). Example 4 shows that the method of the invention is effective at removing starch soils and starch film.

Example 5

Example 5 examined preferred amount of alkaline detergent necessary to achieve the best results. For this test, plates were prepared according to corn starch soiling procedure. The plates were put through a cleaning process in a Hobart AM-14 door dish machine according to the following method: (1) a 30 second alkaline step using Solid Power® (2) a 30 second acid spray with a pause using 0.25% HCl (pH=1.8); and (3) a 30 second alkaline wash using Solid Power®. The temperature of the cleaning solution was 145° F.

TABLE 6

Impact of Alkaline Composition Concentration on Cleaning Performance

| Test | pH | Detergent Concentration | Results |
|---|---|---|---|
| 1 | 11.9 | 60 grams/1000 ppm | 95% of gross soil removed. 50% of starch film removed. |
| 2 | 11.4 | 30 grams/500 ppm | 50% of gross soil removed. Some film remaining. |
| 3 | 11.8 | 45 grams/750 ppm | 50-75% of gross soil removed. Film remaining. |

Table 6 shows that an alkaline composition concentration of 1000 ppm (test 1) provided the best results in terms of soil removal. A 500 ppm concentration (test 2) and a 750 ppm concentration (test 3) did not differ significantly.

Example 6

Example 6 tested the method of the invention in a low temperature cleaning process. Plates were prepared according to the corn starch soiling procedure. An Ecolab ES 2000 door dish machine was operated in "delime" mode (a continuous wash with no rinse and no drain) at 130° F. (54° C.). A detergent was added manually at the beginning of the wash sequence. The cleaning process used for this example was the following: (1) a 60 second wash; (2) a 30 second pause or acid spray; and (3) a 60 second wash. The acidic composition was manually sprayed on the dishes.

TABLE 7

Impact of Low Temperature Cleaning on Cleaning Performance

| Test | pH | First Step Detergent | Second Step Detergent | Third Step Detergent | Results |
|---|---|---|---|---|---|
| 1 | 10.41 | 6.5 grams Solid Fusion | No Detergent | 6.5 grams Solid Fusion | Virtually no soil removed. |
| 2 | 11.20 | 8.5 grams Ultra Klene | No Detergent | 8.5 grams Ultra Klene | Some gross soil removed. |
| 3 | 10.33 | 6.5 grams Solid Fusion | 0.25% sulfamic acid (pH = 1.91) | 6.5 grams Solid Fusion | Improved gross soil removal. |
| 4 | 11.41 | 8.5 grams Ultra Klene | 0.25% sulfamic acid (pH = 1.91) | 8.5 grams Ultra Klene | Improved gross soil removal. |

Including the acidic composition in tests 3 and 4 improved the starch removal performance in a low temperature machine environment. The more alkaline wash water (test 4) had better results.

Example 7

Example 7 tested the method of the invention in a high temperature dish machine. Plates were prepared according to the corn starch soiling procedure. A Hobart AM-14 door dish machine was operated manually. The temperature ranged from 160-165° F. (71° C.-74° C.). The cleaning procedure used for the example was the following: (1) a 30 second alkaline wash; (2) a 30 second pause or a 30 second acid spray; and (3) a 30 second alkaline wash.

TABLE 8

Impact of High Temperature Cleaning on Cleaning Performance

| Test | pH | Temperature (° F.) | First Step Detergent | Second Step Detergent | Third Step Detergent | Results |
|---|---|---|---|---|---|---|
| 1 | 11.91 | 160 | 60 grams/ 1000 ppm Solid Power | No Detergent (Pause) | 60 grams/ 1000 ppm Solid Power | Most of the gross soil was removed. |
| 2 | 11.87 | 164 | 60 grams/ 1000 ppm Solid Power | 25% Sulfamic Acid | 60 grams/ 1000 ppm Solid Power | Virtually all of the gross soil was removed. |
| 3 | 10.59 | 164 | 60 grams/ 1000 ppm Solid Fusion | No Detergent (Pause) | 60 grams/ 1000 ppm Solid Fusion | Virtually all of the gross soil was removed. |
| 4 | 10.60 | 161 | 60 grams/ 1000 ppm Solid Fusion | 25% Sulfamic Acid | 60 grams/ 1000 ppm Solid Fusion | Virtually all of the gross soil was removed. The gray film was also removed. |

Tests 3 and 4 using Solid Fusion had better results than tests 1 and 2 using Solid Power. Tests 2 and 4 included the acidic composition. Tests 2 and 4 were cleaner than tests 1 and 3 that did not use the acidic composition. The plates that were cleaned using the high temperature cleaning method were cleaner than the plates cleaned using the low temperature cleaning method.

Example 8

Example 8 tested various concentrations of acid to determine the minimum concentration necessary to effectively remove starch. Plates were prepared according to the corn starch soiling procedure. The following method was used: (1) 25 second alkaline wash; (2) 30 second pause or acid spray; and (3) 20 second alkaline wash. The test was conducted in a Hobart AM-14 door dish machine at 160° F.-165° F. (71° C.-74° C.).

TABLE 9

Impact of Acid Concentration on Cleaning Performance

| Test | pH | First Step Detergent | Second Step Detergent | Third Step Detergent | Results |
|---|---|---|---|---|---|
| 1 | 10.53 | 30 grams/500 ppm Solid Fusion | No Detergent (Pause) | 30 grams/500 ppm Solid Fusion | Most of the soil was removed but a gray film remained. |
| 2 | 10.53 | 30 grams/500 ppm Solid Fusion | No Detergent (Pause) | 30 grams/500 ppm Solid Fusion | Most of the soil was removed but a gray film remained. |
| 3 | 10.53 | 30 grams/500 ppm Solid Fusion | 0.10% Sulfamic Acid (pH 2.21) | 30 grams/500 ppm Solid Fusion | 98% of the soil was removed and there was not a gray film except for one plate. |
| 4 | 10.53 | 30 grams/500 ppm Solid Fusion | 0.05% Sulfamic Acid (pH 2.51) | 30 grams/500 ppm Solid Fusion | Soiling and gray film remained on the plates. More effective than tests 1 and 2 but not as effective as test 3 (0.10% sulfamic acid). |
| 5 | 10.53 | 30 grams/500 ppm Solid Fusion | 0.10% Sulfamic Acid (pH 2.21) | 30 grams/500 ppm Solid Fusion | Soil and gray film were removed. |
| 6 | 10.23 | 250 ppm Solid Fusion | No Detergent (Pause) | 250 ppm Solid Fusion | Soiling and gray film remained. |
| 7 | 10.23 | 250 ppm Solid Fusion | 0.10% Sulfamic Acid (pH 2.21) | 250 ppm Solid Fusion | Soil and gray film removed. |

Table 9 shows that including an acid in between the alkaline wash steps (tests 3, 4, 5 and 7) is more effective at removing starch than where there is not an acid between the alkaline steps (tests 1, 2, and 6). A 0.05% concentration of sulfamic acid (test 4) is more effective at removing starch than no acid (tests 1, 2, and 6). Also, the 0.10% concentration of the sulfamic acid (test 3, 5, and 7) was more effective at removing the starch soil and the gray film than the 0.05% concentration sulfamic acid (test 4). The 0.10% concentration of sulfamic acid is effective at removing the starch soil and gray film, even when the concentration of the alkaline detergent (Solid Fusion) is reduced from 500 ppm to 250 ppm (test 7 compared with tests 3 and 5).

Example 9

Example 9 tested the impact of applying the acidic detergent through a separate wash arm, for example in a flight machine or a conveyor machine, on cleaning performance. For this example, plates were prepared according to the corn starch soiling procedure. Two Hobart AM-14 door dish machines were run side by side in order to simulate two sumps and two wash arms. The first AM-14 machine applied a 250 ppm solution of Solid Fusion to the plates at a pH of 10.07. The second AM-14 machine applied a 1000 ppm solution of sulfamic acid to the plates at a pH of 2.20. The following method was used in this example: (1) a 20 second alkaline wash at 150° F. (66° C.); (2) a 20 second acidic wash at 160° F. (71° C.); and (3) a 20 second alkaline wash at 150° F. (66° C.). This example should be compared with Tests 6 and 7 in example 8. In test 6, a 250 ppm solution of Solid Fusion was applied to the dishes without an acid spray (control). In test 7, a 250 ppm solution of Solid Fusion was applied along with a 1000 ppm solution of sulfamic acid that was sprayed on the dishes. The results are described in Table 10.

TABLE 10

Impact of Applying the Acidic Detergent Through a Separate Wash Arm on Cleaning Performance

| Test | Results |
|---|---|
| Example 8, Test 6—No acid (control) | Soiling and Gray Film Remained |
| Example 8 - Test 7—Acid Spray Application | Soil and Gray Film Removed |
| Example 9—Wash Arm Application | Most of the Soil and Gray Film Removed. |

Applying the acid with a separate wash arm (Example 9) is more effective at removing starch that not including an acid (Example 8, Test 6). However, applying the acid with a wash arm (Example 9) did not provide additional starch removal when compared to an acid spray (Example 8, Test 7).

Example 10

Example 10 tested the threshold concentration of acid and alkaline detergents necessary to effectively remove starch. For this test, plates were prepared according to the corn starch soiling procedure. A Hobart AM-14 door dish machine was used and operated manually. The acid spray was sprayed on the dishes using a spray bottle. The temperature of the solution was 160° F. (71° C.). The following method was used: (1) a 20 second alkaline wash; (2) a 20 second acid spray; and (3) a 20 second alkaline wash. Sulfamic acid was used and tested at 0%, 0.025%, 0.050%, and 0.10%. The alkaline detergent was Solid Fusion. Solid Fusion was tested in a 16 gallon tank at 125 ppm (7.6 grams), 250 ppm (15.2 grams), 500 ppm (30.3 grams) and 750 ppm (45 grams).

TABLE 11

Concentrations of Alkaline and Acidic Compositions Necessary for Effective Starch Removal

| pH | | | | 2.66 | 2.51 | 2.21 |
|---|---|---|---|---|---|---|
| | Solid Fusion | Sulfamic Acid | 0% (Water Control) | 0.025% | 0.050% | 0.10% |
| | 0 ppm | | Little gross soil removed. Gray film remained. | Not Tested. | Not Tested. | Little gross soil removed. Gray film remained. |
| 9.9 | 125 ppm | | Some gross soil removed. Gray film remained. | Moderate gross soil removed. Gray film partially removed. | Majority of gross soil removed. Gray film remained. | Majority of gross soil removed. Gray film partially removed. |
| 10.2 | 250 ppm | | Some gross soil removed. Gray film remained. | Moderate gross soil removed. Gray film partially removed. | Majority of gross soil removed. Gray film significantly removed. | Majority of gross soil removed. Gray film significantly removed. |
| 10.4 | 500 ppm | | Some gross soil removed. Gray film remained. | Majority of gross soil removed. Gray film significantly removed. | Majority of gross soil removed. Gray film significantly removed. | Substantially all of gross soil removed. Substantially all of gray film removed. |
| 10.4 | 750 ppm | | Majority of gross soil removed. Gray film remained. | | | |

Table 11 shows that the method of the invention is necessary to achieve effective removal of the starch soil and the gray film. The water control (no alkaline, no acid) had little gross soil removal and no removal of the gray film. Including only acid and not alkaline (0.10% sulfamic acid) also produced little gross soil removal and no removal of the gray film. Including only an alkaline detergent at a concentration of 125 ppm, 250 ppm, and 500 ppm, without the acid spray, only provided some gross soil removal but no removal of the gray film. Only when the concentration of the alkaline detergent was increased to 750 ppm was there significant gross soil removal without an acid spray, however, the gray film remained.

Table 11 also shows the minimum concentration of alkaline detergent and acidic detergent in order to achieve effective starch removal. An acid concentration of 0.025% provided moderate removal of the gross starch soil as well as partially dissolving the gray film at alkaline concentrations of 125 ppm and 250 ppm. This is an improvement over not including an acid at all, which only provided some gross soil removal and no removal of the gray film. A 0.025% concentration of acid removed the majority of the gross starch soil when the alkaline concentration was increased to 500 ppm. The starch removal increased when the concentration of the acid was increased from 0.025% to 0.05%. The majority of the gross starch soil was removed when the alkaline concentration was 125 ppm. At 125 ppm, the gray film still remained. However, when the alkaline concentration was increased to 250 ppm and 500 ppm, the majority of the gross starch soil was removed and the gray film was significantly removed. Finally, when the acid concentration was increased from 0.05% to 0.10%, the gross soil removal improved again. At an alkaline concentration of 125 ppm, the majority of the gross soil was removed and the gray film was partially removed. When the alkaline concentration was increased to 250 ppm, the majority of the gross soil was removed and the gray film was significantly removed. Finally, when the alkaline concentration was increased to 500 ppm, the majority of the gross soil was removed and the majority of the gray film was removed.

Example 11

Example 11 tested a mixture of sulfamic acid and citric acid in the method of the invention. For this example, plates were prepared according to the corn starch soiling procedure. A Hobart AM-14 door dish machine was used. For this test, a 500 ppm solution of Solid Fusion was used as the alkaline detergent. A control was run without an acid against a 0.10% solution of FX-3 and a 0.50% solution of FX-3. The following method was used: (1) 20 second alkaline wash; (2) 20 second pause/acid spray; (3) 20 second alkaline wash. The temperature of the solutions was 160° F. (71° C.).

TABLE 12

Impact of Sulfamic Acid/Citric Acid Blend on Cleaning Performance

| Test | pH | First Step Detergent | Second Step Detergent | Third Step Detergent | Results |
|---|---|---|---|---|---|
| 1 | 10.46 | 500 ppm Solid Fusion | No Detergent | 500 ppm Solid Fusion | Gross soil partially removed. Gray film remained. |

TABLE 12-continued

Impact of Sulfamic Acid/Citric Acid Blend on Cleaning Performance

| Test | pH | First Step Detergent | Second Step Detergent | Third Step Detergent | Results |
|---|---|---|---|---|---|
| 2 | 10.46 | 500 ppm Solid Fusion | 0.10% FX-3 (pH = 3.13) | 500 ppm Solid Fusion | Gross soil partially removed. Gray film remained. |
| 3 | 10.46 | 500 ppm Solid Fusion | 0.50% FX-3 | 500 ppm Solid Fusion | Majority of gross soil removed. Majority of gray film removed. |

Table 12 shows that the 0.10% solution of FX-3 did not improve cleaning over the control (Test 1—no acid). The 0.50% solution of FX-3 (Test 3) did improve starch removal over both the control (Test 1) and the 0.10% FX-3 solution (Test 2).

Example 12

Example 12 tested the impact of different acids on cleaning performance. This test was carried out in a Hobart AM-14 door dish machine with a 15 gallon tank. The temperature of the solution was 150° F. (66° C.). The following method was used for this example: (1) 20 second alkaline wash; (2) 20 second acid spray; and (3) 20 second alkaline wash.

TABLE 13

Impact of Different Acids on Cleaning Performance

| Test | pH | First Step Detergent | Second Step Detergent | Third Step Detergent | Results |
|---|---|---|---|---|---|
| 1 | 10.45 | 500 ppm Solid Fusion | 0.10% Sulfamic Acid | 500 ppm Solid Fusion | 30% of soil removed. Gray film remained. |
| 2 | 10.45 | 500 ppm Solid Fusion | 0.10% Vitech BJS-1 | 500 ppm Solid Fusion | 20-30% of soil removed. Gray film remained. |
| 3 | 10.47 | 500 ppm Solid Fusion | No Acid Spray (Pause) | 500 ppm Solid Fusion | 10-20% of soil removed. Gray film remained. |
| 4 | 11.53 | 500 ppm Solid Power | No Acid Spray (Pause) | 500 ppm Solid Power | 20-50% of soil removed. Gray film remained. |
| 5 | 11.69 | 750 ppm Solid Power | No Acid Spray (Pause) | 750 ppm Solid Power | 20-50% of soil removed. Gray film remained. |
| 6 | 10.45 | 500 ppm Solid Fusion | 0.25% Vitech BJS-1 | 500 ppm Solid Fusion | 75% of soil removed. Gray film partially removed. |
| 7 | 10.47 | 500 ppm Solid Fusion | 0.25% Sulfamic Acid | 500 ppm Solid Fusion | 50% of soil removed. Gray film remained. |
| 8 | 11.90 | 1000 ppm Solid Power | No Acid Spray (Pause) | 1000 ppm Solid Power | 70-90% of soil removed. Gray film remained. |
| 9 | 10.48 | 500 ppm Solid Fusion | 0.25% Sulfamic Acid | 500 ppm Solid Fusion | 40% of soil removed. Gray film remained. |

TABLE 13-continued

Impact of Different Acids on Cleaning Performance

| Test | pH | First Step Detergent | Second Step Detergent | Third Step Detergent | Results |
|---|---|---|---|---|---|
| 10 | 10.47 | 500 ppm Solid Fusion | 0.25% Vitech BJS-1 | 500 ppm Solid Fusion | 60% of soil removed. Gray film partially removed. |
| 11 | | Water | Water | Water | 10-20% of soil removed. Gray film remained. |

Table 13 shows that tests with sulfamic acid (tests 1, 7, and 9) and urea hydrochloride (Vitech BJS-1) (tests 2, 6, and 10) performed better than tests 3, 4, 5, 8, and 11 where no acid was included with the exception of test 8 where 1000 ppm of Solid Power was used without an acid. The sulfamic acid and urea hydrochloride with both more effective when included at 0.25% (tests 6, 7, 9, and 10) instead of 0.10% (tests 1, and 2). The urea hydrochloride in tests 2, 6, and 10 worked better than the sulfamic acid in similar tests (tests 1, 7, and 9).

Example 13

Example 13 tested discoloration or corrosion on aluminum strips caused by citric acid, sulfamic acid, and urea hydrochloride. For this test, 1.0% and 0.1% solutions of citric acid, sulfamic acid, and Vitech BJS-1 were prepared. 1"×3" aluminum strips were placed in a glass jar. The jar was filled approximately ¾ full with the test solution. The jars were then placed in a 180° F. (82° C.) water bath for six hours.

TABLE 14

Impact of Citric Acid, Sulfamic Acid, and Urea Hydrochloride on Corrosion

| Solution | Result |
|---|---|
| 0.1% Urea Hydrochloride | Slightly discolored |
| 0.1% Citric Acid | Slightly discolored |
| 0.1% Sulfamic Acid | Slightly discolored |
| 1.0% Urea Hydrochloride | Significant discoloration |
| 1.0% Citric Acid | Moderate discoloration |
| 1.0% Sulfamic Acid | Significant discoloration |

Table 14 shows that the urea hydrochloride, citric acid, and sulfamic acid performed equally at a 0.1% concentration. However, when the same three acids were increased to 1.0% concentrations, the citric acid provided the least discoloration on the aluminum strips.

Example 14

Example 14 tested the method of the invention on the removal of protein, as well as spotting and filming. Example 14 also tested the impact of various surfactants on cleaning performance. Finally, Example 14 looked at the impact of the method of the invention on redeposition soils.

For this example, ten formulas were prepared and tested. The formulas are listed in Table 15.

TABLE 15

Formulas for Example 14

| Test | 1 | 2 | 3 | 4 | 5 | 6 |
|---|---|---|---|---|---|---|
| Alkaline Detergent | 500 ppm Omega Solid | 500 ppm Omega Solid | 500 ppm Omega Solid | 500 ppm Omega Solid | 500 ppm Omega Solid | 500 ppm Omega Solid |

TABLE 15-continued

| Formulas for Example 14 | | | | | | |
|---|---|---|---|---|---|---|
| Acidic Detergent | Detergent No Acid | Detergent 1000-1100 ppm Sulfamic Acid | Detergent 1000-1100 ppm Sulfamic Acid plus 1100 ppm Pluronic N-3 | Detergent No Acid. 30 ppm Glensurf 42. | Detergent 1000-1100 ppm Sulfamic Acid plus 30 ppm Glensurf 42 | Detergent No Acid. 65 ppm Glensurf 42 |
| Rinse Aid | 1 ml Omega Solid Rinse Aid | 1 ml Omega Solid Rinse Aid | 1 ml Omega Solid Rinse Aid | 1 ml Omega Solid Rinse Aid | 1 ml Omega Solid Rinse Aid | 1 ml Omega Solid Rinse Aid |

| Test | 7 | 8 | 9 | 10 |
|---|---|---|---|---|
| Alkaline Detergent | 500 ppm Omega Solid Detergent | 500 ppm Omega Solid Detergent | 500 ppm Omega Solid Detergent | 650 ppm Solid Power |
| Acidic Detergent | 1100 ppm Sulfamic Acid; 30 ppm Glensurf 42; and - ppm Pluronic N3 | No Acid | Citric Acid; Maleic Acid; Pluronic N3; 30 ppm Glensurf 42 | No Acid |
| Rinse Aid | 1 ml Omega Solid Rinse Aid | 1 ml Ultra Dry | 1 ml Ultra Dry | 1 ml Ultra Dry |

For this example, six glasses were prepared for each formula. The glasses were tested to evaluate film accumulation, spotting, and protein accumulation. Three glasses were dipped in whole milk and allowed to dry. The other three glasses remained clean and were evaluated for soil redeposition. During the test a concentration of 1000 ppm food soil was maintained in the wash tank of a modified Inferno HT machine. The food soil included beef stew soils, Hotpoint, and potato soils. The following method was used: (1) a 20 second alkaline wash; (2) a 5 second acid spray followed by a 15 second pause; (3) a 20 second alkaline wash; and (4) a 11 second rinse using 1.5 gallons of water. The acid was pumped into the dish machine by a peristaltic pump at a rate of 9 mls per 5 seconds. The 9 mls of acid was diluted in 200 mls of water to achieve an acid concentration of 1100 ppm and a pH of 2.4. The temperature of the wash was 140° F. to 155° F. The rinse temperature was 180° F.-195° F.

Once the glasses were put though a wash cycle, they were evaluated for spots, film, and protein. In order to determine the protein accumulation, the Commassie dye was applied to the glasses. Table 16 describes the rating system.

TABLE 16

| Explanation of the Grading System | | | |
|---|---|---|---|
| Grade | Spots | Film | Protein |
| 1 | No Spots | No Film | No protein. |
| 2 | Random amount of spots. There are spots but they cover less than ¼ of the glass surface. | Trace amount of film. This is a barely perceptible amount of film that is barely visible under intense spot light conditions, but is not noticeable if the glass is held up to a fluorescent light source. | Light amount of protein. After dyeing glass with Commassie blue reagent, the glass is covered with a light amount of blue. A trace amount of blue is a grade of 1.5. Protein film is not readily visible to the eye unless dyed. |
| 3 | ¼ of the glass surface is covered with spots. | A slight film is present. The glass appears slightly filmed when held up to a fluorescent light source. | A medium amount of protein film is present. |
| 4 | ½ of the glass surface is covered with spots. | A moderate amount of film is present. The glass appears hazy when held up to a fluorescent light source. | A heavy amount of protein is present. |
| 5 | The entire surface of the glass is coated with spots. | A heavy amount of filming is present. The glass appears cloudy when held up to a fluorescent light source. | A very heavy amount of protein is present. A Commassie dyed glass will appear as dark blue. |

Table 17 shows the results of Formulas 1-10 after being cleaned according to this example.

TABLE 17

| Results of Glass Testing | | | | |
|---|---|---|---|---|
| | Test | Spot | Film | Protein |
| 1 | Milk Glasses | 4 | 3.5 | 4 |
| | Redeposit Glasses | 4 | 2 | 1.5 |

TABLE 17-continued

| Results of Glass Testing | | | | |
|---|---|---|---|---|
| | Test | Spot | Film | Protein |
| 2 | Milk Glasses | 3 | 3 | 4 |
| | Redeposit Glasses | 2 | 1 | 2 |
| 3 | Milk Glasses | 2 | 2 | 4 |
| | Redeposit Glasses | 2 | 3 | 1 |
| 4 | Milk Glasses | 4 | 4 | 4 |
| | Redeposit Glasses | 3 | 1 | 1.5 |
| 5 | Milk Glasses | 4 | 1.3 | 3 |
| | Redeposit Glasses | 3 | 1 | 1.5 |
| 6 | Milk Glasses | 4 | 3 | 4 |
| | Redeposit Glasses | 4 | 1 | 2 |
| 7 | Milk Glasses | 2 | 2 | 2 |
| | Redeposit Glasses | 2 | 2 | 1 |
| 8 | Milk Glasses | 2 | 4 | 4 |
| | Redeposit Glasses | 2 | 4 | 1 |
| 9 | Milk Glasses | 2 | 2 | 2 |
| | Redeposit Glasses | 2 | 2 | 1 |
| 10 | Milk Glasses | 2 | 2 | 4 |
| | Redeposit Glasses | 2 | 2 | 1 |

Example 14 shows that the addition of a nonionic and/or a cationic surfactant improves the effectiveness of the acidic composition and the method of the invention. For example, Test 3 included the nonionic surfactant Plurafac N3. The addition of the nonionic surfactant was found to reduce the spotting on the glasses. The spot rating for the control (Test 1—no acid or surfactant) was 4 for both the milk glasses and the redeposit glasses. The spot rating for just the acid, no surfactant (Test 2) was 3 for the milk glasses and 2 for the redeposit glasses. Test 3 included the nonionic surfactant Pluronic N3. The spot rating in test 3 was 2 for the milk glasses and 2 for the redeposit glasses. The reduced spotting in the milk glasses in test 3 is attributed to the nonionic surfactant.

The addition of the cationic surfactant was found to assist in protein removal when used in conjunction with the method of the invention. Tests 4 and 6 included only a cationic surfactant, Glensurf 42, without acid, at two concentrations. Tests 4 had a protein level of 4 for the milk glasses and 1.5 for the redeposit glasses. Test 6, the more concentrated cationic surfactant, had protein levels of 4 for the milk glasses and 2 for the redeposit glasses. Test 2 included only the acid without the cationic surfactant. Test 2 had protein levels of 4 for the milk glasses and 2 for the redeposit glasses. However, when the cationic surfactant was included with the acid, for example in test 5, the protein levels were reduced to 3 for the milk glasses and 1.5 for the redeposit glasses. This reduction in the protein levels is attributed to the cationic surfactant used in conjunction with the acid.

When both a nonionic surfactant and a cationic surfactant were included with the acid, the same results were observed as if they were included separately. In test 7, the spot rating for both the milk glasses and the redeposit glasses was 2 and the protein rating for the milk glasses was 2 and for the redeposit glasses was 1. In comparison, test 8 which did not include the cationic surfactant had protein levels of 4 for the milk glasses and 1 for the redeposit glasses.

Plates were prepared according to the corn starch soiling procedure in order to determine if the formulas were effective at removing starch. Tests 7, 8, and 9 were used on the plates. The results are described in Table 18.

TABLE 18

| Impact of Various Surfactants on Cleaning Performance | |
|---|---|
| Test | Results |
| Test 7 | Majority of gross soil removed. Majority of gray film removed. |
| Test 8 | Some gross soil removed. Gray film remained. |
| Test 9 | Majority of gross soil removed. Majority of gray film removed. |

Table 18 shows that tests 7 and 9, which included the acid plus the nonionic surfactant and cationic surfactant were more effective at remove starch and the gray film than the control which did not include acid or surfactant.

Example 15

Example 15 looked at a solid acid product formula to determine if it would dispense evenly enough to be included with the method of the invention. The formula included 54.6 wt. % citric acid, 5.5 wt. % maleic acid, 14.3 wt. % Pluronic N3, 0.695 Glensurf 42, 13.8 pulverized urea, and 11.0 water. The Pluronic N3, water, and Glensurf 42 were heated to approximately 150° F. Then the citric acid and maleic acid were added. Finally, the urea was added. The composition solidified quickly when it cooled. The sample was placed in a Ecolab Distributor 3000 dispenser and dispensed to a 10% concentration. Random samples were pulled at various times where a 10 ml sample wad diluted into 200 mls of water and analyzed for pH. Table 19 describes the results.

TABLE 19

| pH of Diluted Solid Acid Samples | |
|---|---|
| Time | pH |
| 9:45 | 2.51 |
| 10:05 | 2.34 |
| 10:30 | 2.35 |
| 11:15 | 2.35 |
| 11:25 | 2.35 |

Table 19 shows that the pH remained almost constant, therefore indicating that the solutions were similar and the product was dispensed evenly.

Example 16

Example 16 tested the effect of varying the cleaning time of the first alkaline wash and the second alkaline wash on cleaning performance. Plates were prepared according to the corn starch soiling procedure. For this example, a Hobart AM-14 door dish machine was used. The temperature of the solution was 160° F. (71° C.). The detergents used for this test were the following: (1) 650 ppm Solid Fusion; (2) 0.25% sulfamic acid (pH=1.9); and (3) 650 ppm Solid Fusion. The total wash time for each test was 45 seconds.

TABLE 20

Impact of Varying the Time of the First and Second Alkaline Washes on Cleaning Performance

| Test | Time of First Alkaline Wash (650 ppm Solid Fusion) | Time of Acid Spray (0.25% Sulfamic Acid) | Time of Second Alkaline Wash (650 ppm Solid Fusion) | Results |
|---|---|---|---|---|
| 1 | 15 seconds | 30 seconds | 30 seconds | 99% soil removed. Very little gray film. |
| 2 | 22 seconds | 30 seconds | 23 seconds | 99% soil removed. Some gray film. |
| 3 | 30 seconds | 30 seconds | 15 seconds | 99% soil removed. Some gray film. |
| 4 | 45 second wash with 650 ppm Solid Fusion | | | 50% soil removed. Gray film remaining. |
| 5 | 45 second wash with water only | | | 50% soil removed. Gray film remaining. |
| 6 | 45 second wash with 650 ppm Solid Power | | | 70% soil removed. Gray film remaining. |

Tests 1, 2, and 3 showed excellent results. No significant difference was seen between tests 1, 2, and 3 except that test 1 may have been slightly better. Control tests 4, 5, and 6 did not effectively remove either the starch soil or the gray film.

Example 17

Example 17 tested the ability of a modified Jackson 2018 door dish machine to remove starch using the method of the invention. A Jackson 2018 machine was modified by installing four nozzles in the wash chamber. Two nozzles were on the top of the dish machine in the front corners. Those nozzles used 60° nozzles. The other nozzles were in the center of the bottom of the dish machine. Those nozzles were 120° nozzles. The nozzles were Spraying Systems ⅛ G-SS 1.5W) (120° and ⅛ G-SS 2)(60°. A Rinse Max dispenser commercially available from Ecolab Inc. was used to inject the acid concentrate into a fresh water source that supplies the nozzles at a pumping rate of 82 cc/min. A Dema solenoid was used to control the fresh water flow. All components were 24VAC operated by a single switch that sent power to both the solenoid and the Rinse Max simultaneously.

Plates were prepared according to the corn starch soiling procedure and cleaned in the modified Jackson 2018 machine using a 500 ppm solution of Solid Fusion as the alkaline detergent. The temperature of the solution was 150° F. The method used for this example was as follows: (1) 20 second alkaline wash with 500 ppm Solid Fusion; (2) Acid Spray or Pause; (3) 20 second alkaline wash with 500 ppm Solid Fusion.

TABLE 21

Impact of Modified Door Machine on Cleaning Performance Using the Method of the Invention

| Test | Acidic Step Detergent | Time | Results |
|---|---|---|---|
| 1 | No acid. | | Some gross soil removed. Gray film remained. |

TABLE 21-continued

Impact of Modified Door Machine on Cleaning Performance Using the Method of the Invention

| Test | Acidic Step Detergent | Time | Results |
|---|---|---|---|
| 2 | 0.27% Sulfamic Acid | 10 seconds | Some gross soil removed. Some gray film removed. |
| 3 | 0.27% Sulfamic Acid | 20 seconds | Majority of gross soil and gray film removed. |

Table 21 shows that the modified door machine is effective at removing starch when using the method of the invention. Test 1 did not include the acid and the starch was not effectively removed. Test 2, did include the acid, but only for a 10 second spray. Some of the gross soil and gray film were removed. Test 3 included the acid for a 20 second spray and removed most of the gross soil and gray film.

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A dishwasher machine comprising:

(a) a set of wash arms;

(b) a first set of rinse arms or nozzles;

(c) a second set of rinse arms or nozzles adapted to spray an acid composition, wherein the second set of rinse arms is separate from the first set of rinse arms;

(d) a first tank in fluid communication with the wash arms;

(e) a second tank in fluid communication with the second set of rinse arms;

(f) a first chemical dispenser in fluid communication with the wash arms or the first tank;

(g) a second chemical dispenser in fluid communication with the second set of rinse arms, the second set of nozzles, or the second tank; and (h) a controller;

wherein the dish machine is made out of acid resistant material, and wherein the first dispenser or first tank comprises an alkaline composition and the second dispenser or second tank comprises the acid composition.

2. The machine of claim 1, wherein the machine is selected from the group consisting of a door dish machine and a hood dish machine.

3. The machine of claim 1, wherein the dish machine is a high temperature dish machine.

4. The machine of claim 1, wherein the dish machine is a low temperature dish machine.

5. The machine of claim 1, wherein the first and second dispensers are located on the dish machine.

6. The machine of claim 1, wherein the first and second dispensers are located outside the dish machine.

7. The machine of claim 1, wherein the first and second dispensers are located in the dish machine.

8. The machine of claim 1, wherein the first and second dispensers are located remotely from the dish machine.

9. The machine of claim 1, wherein the first and second dispensers are independently selected from the group consisting of a peristaltic pump, a bellows pump, a solid product spray, flood dissolution, and gravity feed.

10. The machine of claim 1, further comprising a heater.

* * * * *